US011939729B2

(12) United States Patent
Kia et al.

(10) Patent No.: US 11,939,729 B2
(45) Date of Patent: Mar. 26, 2024

(54) HIGH STRENGTH POROUS CEMENT-BASED MATERIALS

(71) Applicant: Imperial College Innovations Limited, London (GB)

(72) Inventors: Alalea Kia, London (GB); Hong S. Wong, London (GB); Christopher R. Cheeseman, London (GB)

(73) Assignee: Imperial College Innovations Limited, London (GB)

( * ) Notice: Subject to any disclaimer, the term of this patent is extended or adjusted under 35 U.S.C. 154(b) by 78 days.

(21) Appl. No.: 17/293,314

(22) PCT Filed: Nov. 13, 2019

(86) PCT No.: PCT/GB2019/053217
§ 371 (c)(1),
(2) Date: May 12, 2021

(87) PCT Pub. No.: WO2020/099868
PCT Pub. Date: May 22, 2020

(65) Prior Publication Data

US 2022/0010500 A1 Jan. 13, 2022

(30) Foreign Application Priority Data

Nov. 13, 2018 (GB) ..... 1818513

(51) Int. Cl.
*E01C 11/22* (2006.01)
*E01C 5/06* (2006.01)

(52) U.S. Cl.
CPC ..... *E01C 11/225* (2013.01); *E01C 5/065* (2013.01); *E01C 2201/20* (2013.01)

(58) Field of Classification Search
CPC ..... E01C 5/065; E01C 11/225; E01C 2201/20
USPC ..... 404/34–43, 72, 75
See application file for complete search history.

(56) References Cited

U.S. PATENT DOCUMENTS

| | | | | |
|---|---|---|---|---|
| 5,342,141 | A * | 8/1994 | Close | E01C 5/001 404/28 |
| 6,171,015 | B1 * | 1/2001 | Barth | E01C 5/001 404/34 |
| 6,739,797 | B1 * | 5/2004 | Schneider | E02B 3/14 405/20 |
| 8,496,396 | B1 | 7/2013 | Allen | |
| 2005/0224690 | A1 | 10/2005 | Hobbs | |
| 2008/0190059 | A1 | 8/2008 | Hobbs | |

(Continued)

FOREIGN PATENT DOCUMENTS

| | | | |
|---|---|---|---|
| CN | 2560481 | Y | 7/2003 |
| CN | 201648906 | U | 11/2010 |
| CN | 104047215 | A | 9/2014 |

(Continued)

OTHER PUBLICATIONS

Combined PCT International Search Report and Written Opinion, PCT App. No. PCT/GB2019/053217, dated Jun. 26, 2020, 20 pages.

(Continued)

*Primary Examiner* — Raymond W Addie
(74) *Attorney, Agent, or Firm* — McDonnell Boehnen Hulbert & Berghoff LLP

(57) ABSTRACT

Method of forming a cement-based material pad (3) comprising a plurality of drainage holes and forms for use in such a method.

19 Claims, 11 Drawing Sheets

(56) References Cited

U.S. PATENT DOCUMENTS

2014/0017008 A1* 1/2014 Allen ..... E01C 11/18
404/134

FOREIGN PATENT DOCUMENTS

| | | | |
|---|---|---|---|
| CN | 205295856 | U | 6/2016 |
| CN | 207079438 | U | 3/2018 |
| CN | 108149538 | A | 6/2018 |
| EP | 1182020 | A1 | 2/2002 |
| EP | 2631362 | A1 | 8/2013 |
| JP | H1044114 | A | 2/1998 |
| KR | 20110080467 | A | 7/2011 |
| KR | 101198687 | B1 | 11/2012 |
| KR | 20160108931 | A | 9/2016 |

OTHER PUBLICATIONS

UKIPO Combined Search and Examination Report under Sections 17 and 18(3), App. No. GB1818513.2, dated May 9, 2019, 8 pages.

Kia, Alalea, Hong S. Wong, and Christopher R. Cheeseman. "Clogging potential of permeable concrete." 37th Cement and Concrete Science Conference, Sep. 11-12, 2017, University College London, Paper No. 60.

Kia, Alalea, Hong S. Wong, and Christopher R. Cheeseman. "Clogging in permeable concrete: A review." Journal of Environmental Management 193 (2017): 221-233.

* cited by examiner (a) 15% P (b) 8% P (c) 5% P (d) 4% P (e) 11% P (f) 8% P (g) 30% P (h) 8% P (a)

(b)

(a)

(b)

HIGH STRENGTH POROUS CEMENT-BASED MATERIALS

CROSS-REFERENCE TO RELATED APPLICATIONS

This application is a U.S. National Stage entry of International Patent Application no. PCT/GB2019/053217, filed Nov. 13, 2019, which claims the benefit of priority of United Kingdom Patent Application no. 1818513.2, filed Nov. 13, 2018.

TECHNICAL FIELD

The present disclosure is related to a method of forming a cement-based material pad comprising a plurality of drainage holes and forms for use in such a method.

BACKGROUND OF THE INVENTION

For the last century and a half, societies have become increasingly urbanised. As our cities expand, they become more vulnerable to flooding as impermeable surfaces are wholly incapable of absorbing rainfall. Therefore flooding, whether mild or catastrophic in nature has become increasingly likely. Flooding impacts on lives, commerce and society as a whole, to say nothing of the cost of damage, which is measured in billions of pounds per year in the UK alone.

In recent years, permeable pavements have been increasingly promoted as an effective sustainable drainage system (SuDS) to mitigate surface flooding in urban areas. Permeable concrete (PC), also known as pervious concrete, is a popular type of permeable pavement as it has the ability to transport large volumes of water through the porous structure of the material. However, the pore structure of permeable concrete can become clogged by sediment particles and its ability to drain storm-water runoff gradually decreases. A. Kia et al., J. Environ. Manage. 193 (2017), 221-233, the entire contents of which are incorporated herein by reference, presented a recent review of this topic.

The problem, which causes clogging in existing permeable concrete, is the high tortuosity of the pore network, with variable path cross-sections and random interconnectivity. Tortuosity is a measure of geometric complexity of a porous medium, in this case permeable concrete. Each flow path through permeable concrete has a different tortuosity and the probability of particulates retaining and accumulating within narrow pore constrictions increases with increase in tortuosity. As such, the potential for clogging becomes greater for porous materials with high tortuosity. Therefore, it is important to develop clogging resistant permeable concrete that retains sufficient high porosity and permeability for storm-water to infiltrate throughout its service life without requiring substantial maintenance. One approach is to engineer a pore structure that is uniform and low tortuosity. It is expected that surface runoff will be effectively transferred through such a material with a much reduced risk of retaining solid particulates.

Furthermore, it would be advantageous for the pervious pavement to have high compressive strength to enable use in heavily loaded applications. Conventional permeable concretes rely on high porosity to achieve sufficient permeability, and consequently are low strength systems restricted to light traffic or pedestrian pavements. Therefore, a major research challenge is to develop a new type of high strength clogging resistant permeable pavement (CRP) that is highly porous, but has low tortuosity and is deliverable on site without reducing the mechanical properties of the concrete. Achieving this will enhance the efficiency, durability and cost effectiveness of permeable pavement, thereby enabling its wider application.

SUMMARY OF THE INVENTION

The disclosure relates to the production of permeable pavement with low tortuosity pore structure that can be cast on-site or provided in pre-cast blocks that is not only resistant to clogging, but also has high permeability and strength. This high strength clogging resistant permeable pavement (CRP) may be prepared by introducing straight conduits of varying size and number into cement-based material. This high strength clogging resistant permeable pavement is capable of retaining sufficient porosity and permeability for storm-water infiltration without requiring frequent maintenance and may be used to help alleviate urban flooding and contribute towards a more sustainable urbanisation.

Accordingly, the disclosure provides a method of forming a cement-based material pad comprising a plurality of drainage holes by providing a form having a plurality of straight conduits and pouring a cement-based material into said form to surround the conduits such that the conduits create a plurality of straight pores through the cement-based material.

The form may comprise a sheet with the plurality of conduits connected thereto and the cement-based material may be poured onto the sheet to surround the conduits and submerge the sheet.

Thus, in a first aspect, the invention provides a method of forming a cement-based material pad comprising a plurality of drainage holes, the method comprising:

- providing a form comprising a sheet and a plurality of straight conduits, each conduit having an upper end and a lower end, wherein each conduit has a constant cross-section and forms a channel from the upper end to the lower end that passes through the sheet; and the form being an open-top form whereby a cement-based material can be poured onto the sheet to surround the conduits;
- placing said form; and
- pouring a cement-based material into said form until the cement-based material surrounds the conduits, leaving the upper ends of the conduits exposed.

Each of the plurality of conduits may be arranged substantially perpendicular to the sheet. Each of the plurality of conduits may be arranged parallel to one another.

The sheet may be a flexible sheet, for example a flexible plastic and/or textile membrane or mesh. This enables the form to be stored compactly (e.g., rolled up) and then expanded (e.g., rolled out) in the place where the cement-based material pad is to be formed. Alternatively, the sheet may be a rigid sheet, for example a rigid metal or rigid plastic mesh.

The sheet may be impermeable to cement, such that the cement-based material poured into the form does not come into contact with the surface on which the cement-based material pad is to be formed. The sheet may be permeable to water.

The sheet and the lower end of the conduits may be adjacent, for example such that the lower ends of the conduits and the sheet lie in a plane (e.g., a horizontal plane). Thus, when placed on a surface (e.g., the ground on which the cement-based material pad is to be formed), the sheet lies flat on the surface with the conduits protruding therefrom (for example, upwardly protruding).

The form may further comprise a connecting means holding each of the plurality of conduits parallel to one another, wherein when the cement-based material is poured onto the sheet to surround the conduits, the upper ends of the conduits and the connecting means are left exposed. The connecting means may then be removed once the cement-based material has set. Alternatively, the connecting means may be submerged by the cement-based material and left embedded in the cement-based material.

As would be appreciated by a skilled person, the sheet and the connecting means both serve to hold the plurality of conduits in place when the cement-based material is poured into the form.

Alternatively, the form may comprise a plurality of pins and a connecting means to hold and guide the plurality of conduits. The cement-based material may be poured to surround the conduits and the plurality of pins and connecting means may be removed from above the cement-based material.

Thus, in a second aspect, the invention provides a method of forming a cement-based material pad comprising a plurality of drainage holes, the method comprising:

providing a form comprising a plurality of parallel pins each having a shaft, a head and a pointed end; a connecting means configured to hold the plurality of pins parallel to each other, wherein the connecting means connects the head of each of the plurality of parallel pins; a plurality of straight conduits, each having an upper end and a lower end; wherein each conduit has a constant cross-section and receives one of the plurality of parallel pins such that the pointed ends of each of the plurality of parallel pins extend beyond the lower end of each conduit; whereby a cement-based material can be poured to surround the conduits;

placing said form; and pouring a cement-based material into said form until the cement-based material surrounds the conduits, leaving the upper ends of the conduits exposed.

The cement-based material pad may be formed on a surface and the step of placing said form may comprise placing said form such that the pointed ends of each of the parallel pins penetrate the surface to anchor the form.

Each of the pointed ends of each of the parallel pins may extend beyond the lower end of each conduit so as to seal the lower end of the conduit. This may prevent the cement-based material obstructing the lower end of each conduit when the cement-based material is poured to surround the conduits The connecting means may extend substantially perpendicular from each of the plurality of parallel pins.

As would be appreciated by a skilled person, the connecting means of the first and second aspect of the invention both serve to hold the plurality of conduits in place when the cement-based material is poured into the form. The connecting means of the second aspect of the invention does this by holding the plurality of pins parallel to each other.

Each conduit may reversibly receive one of the plurality of parallel pins. This enables the plurality of parallel pins and the connecting means to act as a guide or template for the plurality of conduits in the forming of the cement-based material pad and then, once the cement-based material has set, the plurality of parallel pins and the connecting means can be removed (and reused to form another cement-based material pad), leaving the plurality of conduits in place. Thus, the method may further comprising the step of removing the plurality of pins from each of said conduits.

In any of the methods described herein, each of the plurality of conduits may have a circular cross-section. This enables formation of a cement-based material pad having a plurality of drainage holes of circular cross-section.

Preferably the conduits have a uniform diameter along their length.

Combinations of different size, diameter, cross-section conduits may be used within the form depending on the requirements for the pad.

In any of the methods described herein, each of the plurality of conduits may independently have a diameter of about 1 to about 20 mm, optionally about 2 to about 15 mm, optionally about 3 to about 10 mm.

In any of the methods described herein, each of the plurality of conduits and/or the sheet may be formed from plastic or a biodegradable material.

The conduits may be made of polypropylene, polystyrene or any other inflatable or soluble material.

In any of the methods described herein, the form may further comprise side walls to contain the cement-based material.

The method described herein may further comprising the step of setting the cement-based material, optionally further comprising the step of curing the cement-based material.

The method described herein may further comprising the step of trimming a portion of each of the plurality of conduits exposed from the cement-based material (e.g., exposed above the surface of the cement-based material). Trimming the plurality of conduits may comprise trimming conduits such that all of each of the conduits exposed above the surface of cement-based material is removed such that the surface of the cement-based material is flat. The trimming may be carried out using any suitable means, for example a wire cutter, a blade or knife or a hot wire or a flame gun.

In any of the methods described herein, the plurality of conduits may be arranged such that a cement-based material pad having porosity of about 1 to about 50% is formed, optionally about 2 to about 40%, optionally about 2 to about 30%, optionally about 3 to about 30%. As used herein, a percentage porosity refers to the percentage volume of the cement-based material pad that is taken up by the plurality of drainage holes compared to the total volume of the cement-based material pad (including the volume taken up by the cement-based material and the drainage holes).

The form may be placed on a sub-base layer formed of packed coarse aggregates or a geocellular layer. This may enable water that goes through the pores to go down into this layer and then slowly to be directed to the soil layer underneath.

The methods of forming a cement-based material pad (for example, high-strength clogging resistant permeable pavement) can be carried out both in-situ (on site) or they can be pre-cast.

An in-situ method may comprise interlocking tiles of the form which are placed either on a sub-base layer. A cement-based material may then be poured on top of these tiles, leaving part of the conduits protruding, to the required pavement thickness. The tiles of the form may be interlocking for ease of transportation and installation and may be manufactured as one piece using injection moulding.

The cement-based material pad formed form the methods may have a compressive strength of about 50 MPa or greater.

The cement-based material may be a construction material that comprises a binder and optionally an aggregate. The binder may be a cement binder or a binder suitable for use in a construction material as an alternative to a cement binder in conventional cement concretes (for example bitumen materials or polymer binders or resins). The cement-based material may be a material that comprises a cement binder and optionally an aggregate (such as particles of stone or sand), optionally the cement-based material may be mortar (for example, self-compacting mortar) or concrete. Alternatively, the material may be a bitumen bound material, such as asphalt, or a polymer concrete or any other cement alternative.

In a third aspect, the invention provides a form for use in producing a cement-based material pad comprising a plurality of drainage holes, the form comprising:

a sheet; and a plurality of straight conduits, each having an upper end and a lower end;

wherein each conduit has a constant cross-section and forms a channel from the upper end to the lower end that passes through the sheet; and the form being an open-top form whereby a cement-based material can be poured onto the sheet to surround the conduits, leaving the upper ends of the conduits exposed.

Each of the plurality of conduits may be arranged substantially perpendicular to the base. Each of the plurality of conduits may be arranged parallel to one another.

The sheet may be a flexible sheet, for example a flexible plastic and/or textile membrane or mesh. Alternatively, the sheet may be a rigid sheet, for example a rigid metal or rigid plastic mesh.

The sheet and the lower end of the conduits may be adjacent, for example such that the lower ends of the conduits and the sheet lie in a plane (e.g., a horizontal plane).

The form may further comprise a connecting means holding each of the plurality of conduits parallel to one another, wherein when the cement-based material is poured onto the sheet to surround the conduits, the upper ends of the conduits and the connecting means are left exposed. Alternatively, the connecting means may be submerged by the cement-based material and left embedded in the cement-based material.

In a fourth aspect, the invention provides a form for use in producing a cement-based material pad comprising a plurality of drainage holes, the form comprising:

a plurality of parallel pins each having a shaft, a head and a pointed end;

a connecting means configured to hold the plurality of pins parallel to each other, wherein the connecting means connects the head of each of the plurality of parallel pins; a plurality of straight conduits, each having an upper end and a lower end;

wherein each conduit has a constant cross-section and is configured to receive one of the plurality of parallel pins;

wherein a cement-based material can be poured to surround the conduits, leaving the upper ends of the conduits exposed; and each of the parallel pins being configured such that the pointed end extends beyond the lower end of each conduit so as to prevent a cement-based material obstructing the lower end of each conduit when the cement-based material is poured to surround the conduits.

Each conduit may receive one of the plurality of parallel pins such that the pointed ends of each of the plurality of parallel pins extend beyond the lower end of each conduit.

The cement-based material pad may be configured to be formed on a surface and the pointed ends of each of the parallel pins may be configured to penetrate the surface to anchor the form.

Each of the parallel pins may be configured such that the pointed end extends beyond the lower end of each conduit so as to seal the lower end of the conduit.

The connecting means may extend substantially perpendicular from each of the plurality of parallel pins.

Each conduit may be configured to reversibly receive one of the plurality of parallel pins.

Each of the plurality of conduits may have a circular cross-section. Each of the plurality of conduits may independently have a diameter of about 1 to about 20 mm, optionally about 2 to about 15 mm, optionally about 3 to about 10 mm.

Each of the plurality of conduits and/or the sheet may be formed from plastic or a biodegradable material.

In any of the methods described herein, the form may further comprise side walls to contain the cement-based material.

In a fifth aspect, the invention provides the use of a form as described herein for producing a cement-based material pad comprising a plurality of drainage holes.

In a sixth aspect, the invention provides a cement-based material pad comprising a plurality of drainage holes formed by any method as described in relation to the first or second aspects of the invention.

The features discussed in relation to the methods of the first and second aspects of the invention apply mutatis mutandis to all other aspects of the invention, including the forms, pad and uses described above.

DETAILED DESCRIPTION

Figure 1:
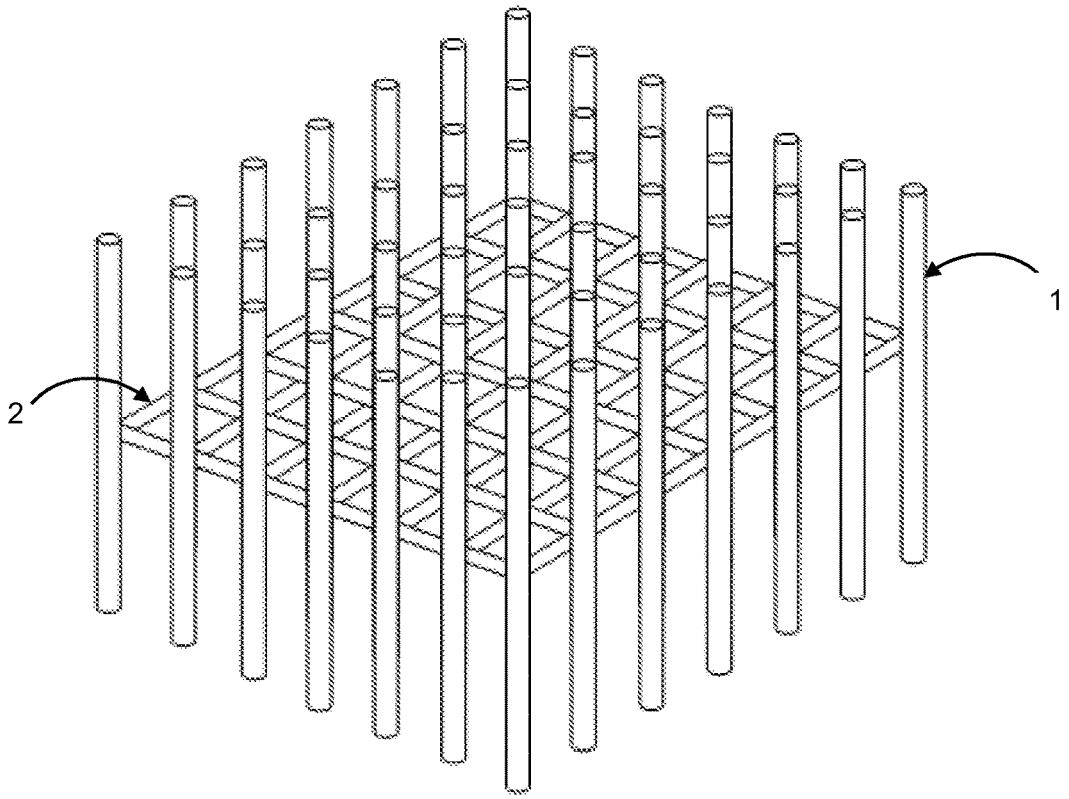
FIG. 1 shows an isometric view of a form according to the third aspect of the invention.

The disclosure enables the production of permeable pavement with low tortuosity pore structure that can be cast on-site or provided in pre-cast blocks that is not only resistant to clogging, but also has high permeability and strength. This high strength clogging resistant permeable pavement is capable of retaining sufficient porosity and permeability for storm-water infiltration without requiring frequent maintenance and may be used to help alleviate urban flooding and contribute towards a more sustainable urbanisation.

Accordingly, the disclosure provides a method of forming a cement-based material pad comprising a plurality of drainage holes by providing a form having a plurality of straight conduits and pouring a cement-based material into said form to surround the conduits such that the conduits create a plurality of straight drainage holes (or pores) through the cement-based material.

In these methods, the dimensions of the conduits (in particular the height, i.e. the depth of the pavement) can be varied depending on the site requirements.

By virtue of the plurality of conduits being straight and having a constant cross-section, the plurality of drainage holes have a low tortuosity (e.g., of about 1). As used herein, tortuosity is related to the inverse of connectivity, and usually defined as the ratio of actual flow path length to the straight distance between the ends of the flow path (J. Bear, Dynamics of Fluids in Porous Media, Dover Publications, New York, 1988, i.e. the arc-chord ratio (the ratio of the length of the curve (L) to the distance between the ends of it (C)):

$$T = \frac{L}{C} \tag{0}$$

Arc-chord ratio equals 1 for a straight line and is infinite for a circle.

As used herein, a cement-based material is a construction material that comprises a binder and optionally an aggregate. The binder may be a cement binder or a binder suitable for use in a construction material as an alternative to a cement binder in conventional cement concretes. Such binders suitable for use in a construction material as an alternative to a cement binder in conventional cement concretes may, for example, include bitumen materials or polymer binders or resins.

As used herein, a cement-based material is a construction material that comprises a cement binder and optionally an aggregate (such as particles of stone or sand). The aggregate may be fine particles (for example, sand) or course particles (for example, gravel). A cement-based material may be mortar (for example, self-compacting mortar) or concrete. Use of self-compacting mortar may provide a homogenous flow around the conduits.

For example, self-compacting mortar may comprise cement, fine-grain sand, water, and optionally superplasticiser.

The construction material described herein may be bitumen bound materials, such as asphalt, or polymer concrete or any other cement alternatives.

The disclosure also provides forms for use in the methods described herein.

Embodiments are now described by way of non-limiting example to illustrate aspects and principles of the disclosure, with reference to the accompanying figures.

In the following description, terms such as upper, lower, above and below, and the like, are used solely for the purpose of clarity in illustrating the invention, and should not be taken as words of limitation. The figures are for the purpose of illustrating the invention and are not intended to be to scale.

Figure 2:
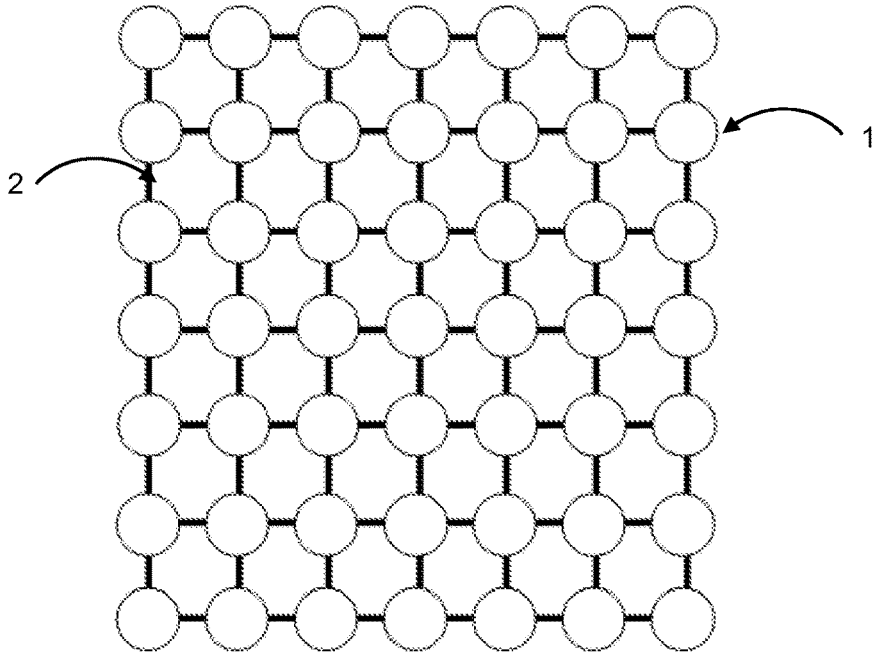
FIG. 2 shows a plan view of a form according to the third aspect of the invention.

With reference to FIGS. 1 and 2, there is provided a form according to the third aspect of the invention for use in producing a cement-based material pad comprising a plurality of drainage holes. The form comprises a sheet (2) and a plurality of straight conduits (1), each having an upper end and a lower end. Each conduit has a constant cross-section and forms a channel from the upper end to the lower end that passes through the sheet (2). The form is an open-top form whereby a cement-based material can be poured onto the sheet to surround the conduits, leaving the upper ends of the conduits exposed.

Figure 3:
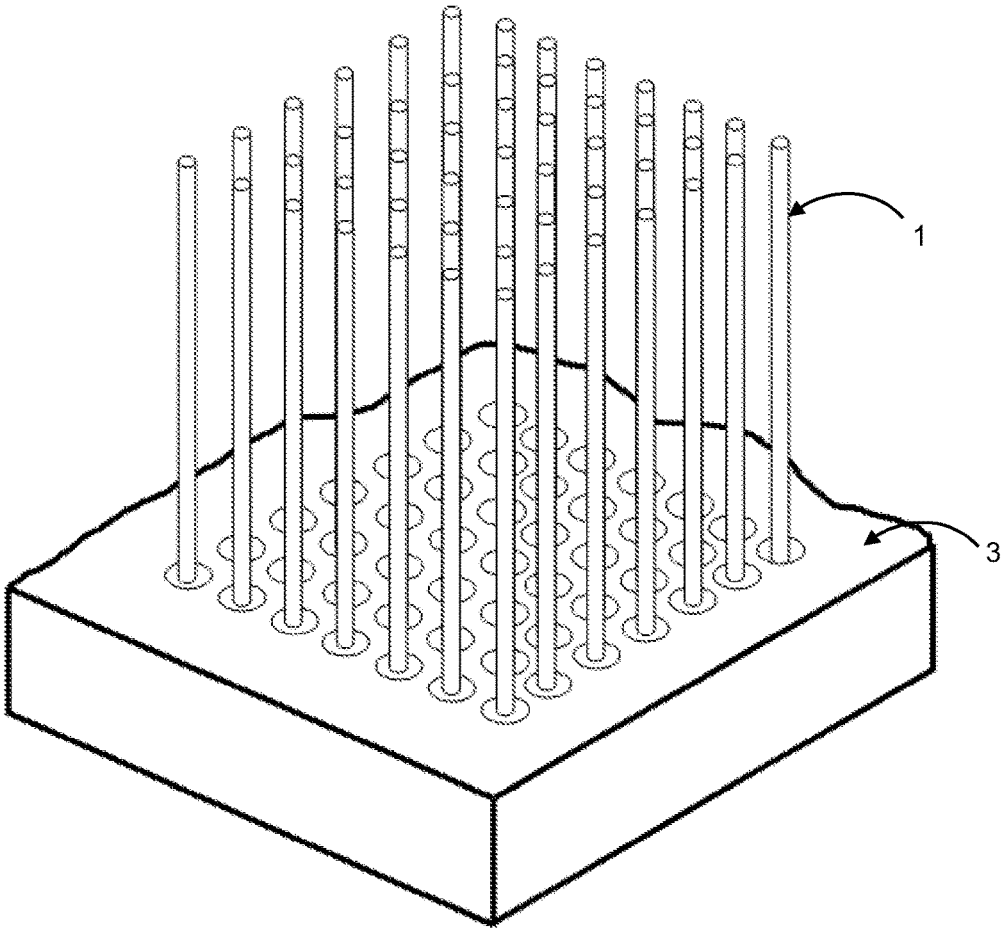
FIG. 3 shows an isometric view of a form according to the third aspect of the invention, submerged by a cement-based material, accordance line with the first aspect of the invention.

With reference to FIG. 3, there is provided a form according to the third aspect of the invention, wherein a cement-based material (3) has been poured onto the sheet to surround the conduits (1), leaving the upper ends of the conduits exposed, and submerge the sheet.

Figure 4:
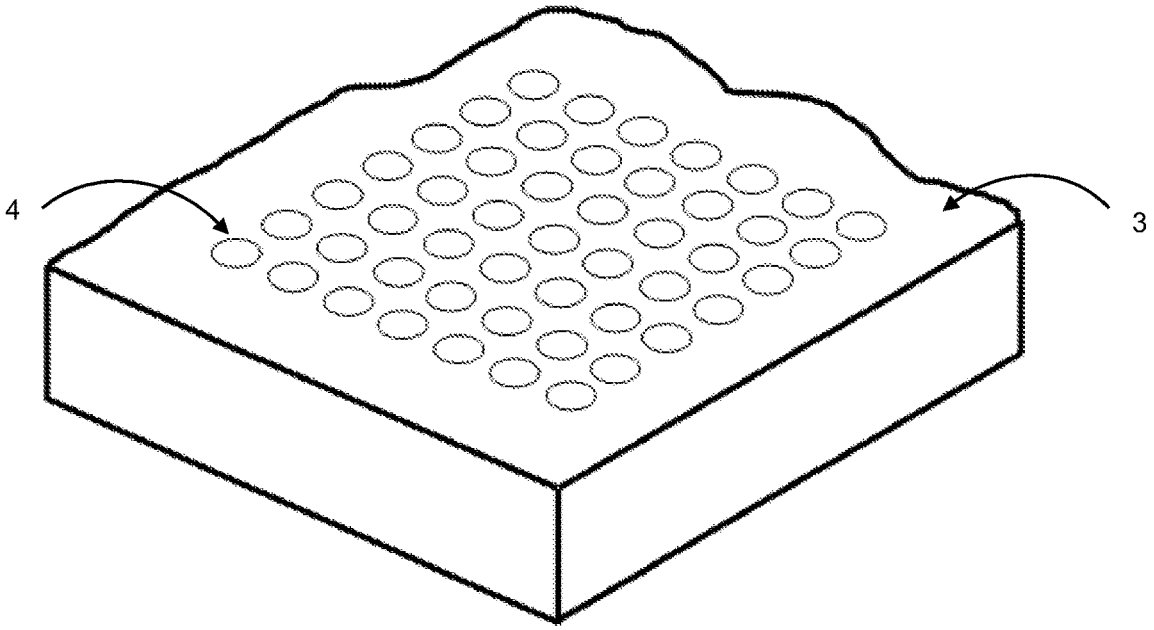
FIG. 4 shows an isometric view of a pad formed by a process according to the first or second aspects of the invention.

With reference to FIG. 4, there is provided a cement-based material pad (3) formed by a process according to the first or second aspects of the invention. The portions of each of the plurality of conduits exposed from the cement-based material have been trimmed, such that all of the portions of each of the conduits exposed above the surface of cement-based material have been removed such that the trimmed upper end of the conduits (4) and the surface of the cement-based material is flat.

Figure 5:
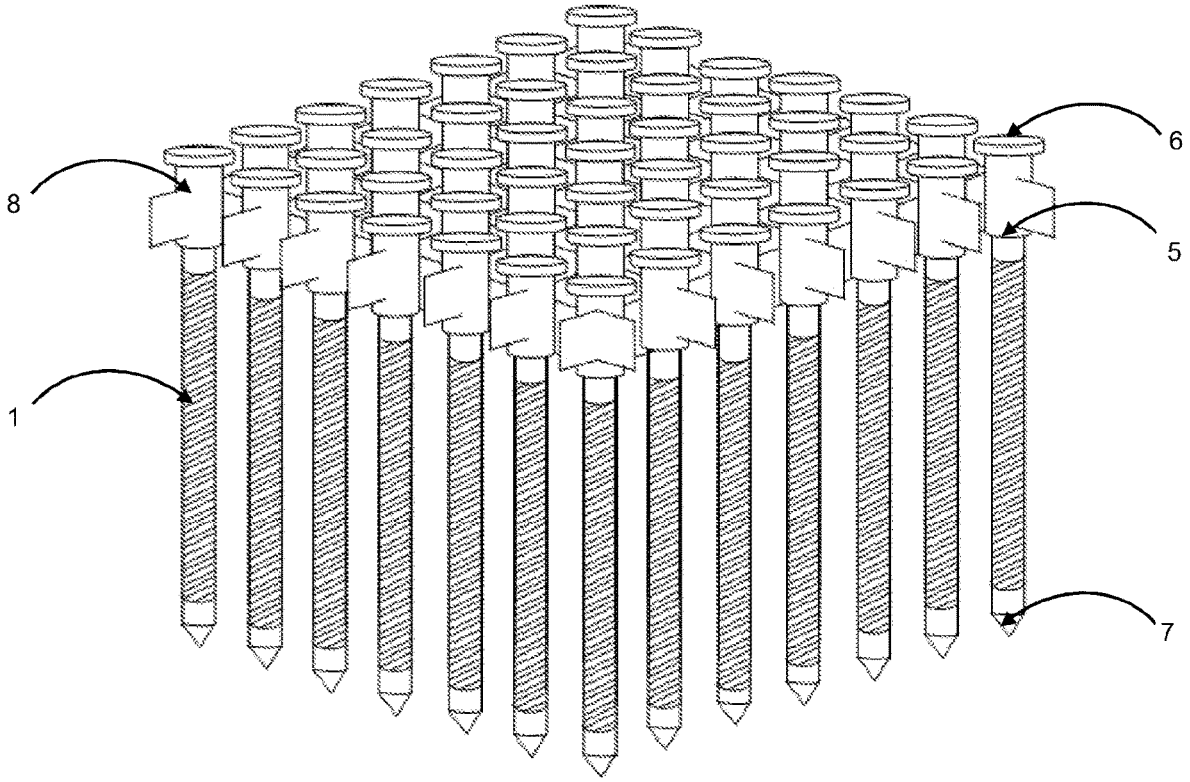
FIG. 5 shows an isometric view of a form according to the fourth aspect of the invention

With reference to FIG. 5, there is provided a form according to the fourth aspect of the invention for use in producing a cement-based material pad comprising a plurality of drainage holes. The form comprises a plurality of parallel pins (5) each having a shaft, a head (6) and a pointed end (7). The form further comprises a connecting means (8) configured to hold the plurality of pins parallel to each other, wherein the connecting means connects the head of each of the plurality of parallel pins. The form further comprises a plurality of straight conduits (1), each having an upper end and a lower end. Each conduit has a constant cross-section and is configured to receive one of the plurality of parallel pins (5). A cement-based material can be poured to surround the conduits (1), leaving the upper ends of the conduits exposed. Each of the parallel pins (5) is configured such that the pointed end (7) extends beyond the lower end of each conduit (1) so as to prevent a cement-based material obstructing the lower end of each conduit (1) when the cement-based material is poured to surround the conduits (1).

The conduits can be tapered, for example, to absorb or attenuate noise as vertical walls or pavements.

The porous cement-based material pads can be used together with a source of energy to ensure that any snow/ice that accumulates on the surface of the pad is melted and drained away. This is particularly relevant for use in airport runways where there are concerns over the environmental impacts caused by extensive use of de-icing chemicals.

The porous cement-based material pads and the sub-base layer can be provided vertically to deliver green walls. The conduits in a green wall system can be a medium for seeds to grow in whilst the nutrients and water will be supplied to the plants through the pores.

The size, number, shape, spacing and arrangement of the conduits are features that can be optimised for intended application.

The porous cement-based material pads described herein have a relatively high strength (>50 MPa)/to be of particular use in the most extreme environments, the strength and durability of the product may be further enhanced by incorporating, for example, mesh reinforcement around the conduits to deliver the first steel-reinforced permeable pavement strong enough for the most demanding environments.

The composition of the cement-based material can also be changed to incorporate microsilica, calcium alumino cements, accelerators or fibres to further enhance the strength.

Surface texturing can be carried out to improve skid resistance of the pavement surface, if required.

The conduits can be made of polypropylene, polystyrene or any other inflatable or soluble material.

Throughout the description and claims of this specification, the words "comprise" and "contain" and variations of the words, for example "comprising" and "comprises", mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

It will be appreciated that many of the features described above, particularly of the preferred embodiments, are inventive in their own right and not just as part of an embodiment of the present invention. Independent protection may be sought for these features in addition to or alternative to any invention presently claimed.

Reference is now made to the following examples, which illustrate the invention in a non-limiting fashion.

Examples

Sample Preparation

Three different cement-based material sample types were tested: a) conventional permeable concrete prepared in the laboratory (PC-Lab), b) conventional permeable concrete available in the market (PC-Com) and c) a cement-based material pad according to the invention (a high strength clogging resistant permeable pavement (CRP)).

The laboratory prepared conventional permeable concrete (PC-Lab) had 11-30% target porosity and these were made using CEM I 52.5 N, water/cement (w/c) ratio of 0.35 and Thames Valley gravel. The gravel had particle size ranging from 1.24 to 14 mm, a 24-h absorption of 1.76% and a specific gravity of 2.51. Mix proportions are based on absolute volume. In order to calculate the required paste volume, the target porosity was deducted from the packed aggregate void content and a 5% compaction index was added. The required cement and water contents were then calculated from the paste volume and w/c ratio. Finally, coarse aggregate content was calculated from the paste volume and target porosity. Trial mixing and testing indicated that this approach resulted in samples with target porosity close very to the measured void content. The paste drain down effect was observed in two mixes and so a viscosity-modifying admixture (VMA) (MasterMatrix SDC) was added to the affected mixes. Table 1 shows the mix proportions of laboratory prepared permeable concrete samples.

TABLE 1

Mix proportions of conventional permeable concrete (PC-Lab) prepared in the laboratory.

| Mix | Cement ($kg/m^3$) | Gravel ($kg/m^3$) | Water ($kg/m^3$) | VMA (%, $kg/m^3$) | w/c | Paste vol. (%) | Target porosity (%) |
|---|---|---|---|---|---|---|---|
| 11% P | 315 | 1481 | 110 | — | 0.35 | 21 | 11 |
| 19% P | 255 | 1581 | 89 | — | 0.35 | 17 | 19 |
| 25% P | 255 | 1581 | 89 | 0.2, 0.5 | 0.35 | 17 | 25 |
| 26% P | 180 | 1581 | 63 | — | 0.35 | 12 | 26 |
| 26% P* | 255 | 1581 | 89 | 0.3, 0.8 | 0.35 | 17 | 26 |
| 30% P | 105 | 1581 | 37 | — | 0.35 | 7 | 30 |

*Mixes of similar porosity are differentiated by using an asterisk.

Samples were cast in steel moulds (100×100×100 mm cubes) and Perspex cylinders (100Ø×150 mm), and compacted in three equal layers using a vibrating table of adjustable intensity. 36 PC-Lab samples were prepared in total. A widely recognised and accepted standard compaction method for permeable concrete has not yet been developed. Therefore, preliminary tests were carried out to study the effect of compaction time on void content of packed Thames Valley gravel. It was observed that 75 s was required to achieve a maximum. As such, PC-Lab samples were compacted in three layers, each for 25 s.

Figure 6:
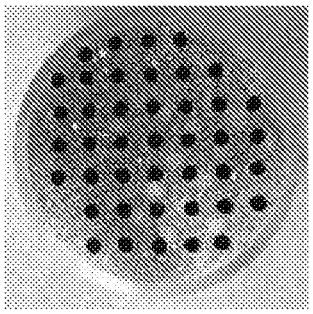
FIG. 6 shows a high strength clogging resistant permeable pavement (CRP) cement-based material pad having a plurality of straight drainage hole (plastic conduits) of varying size and number in self-compacting mortar to achieve porosity ranging from 4 to 30%. Samples tested include 100Ø× 150 mm cylinders (a-d), 100 mm cubes (e, f) and 100×100× 500 mm prisms (g, h).
Figure 6:
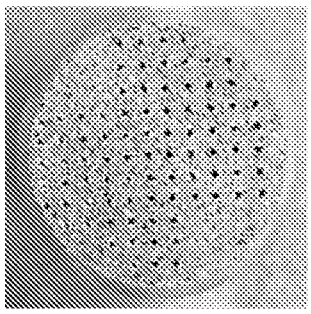
Figure 6:
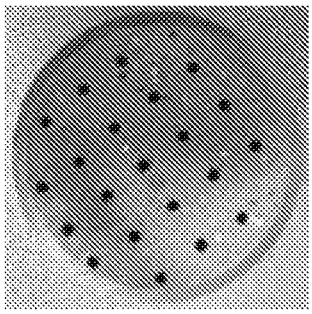
Figure 6:
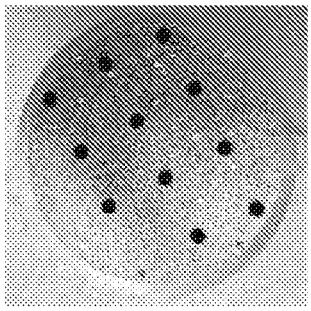
Figure 6:
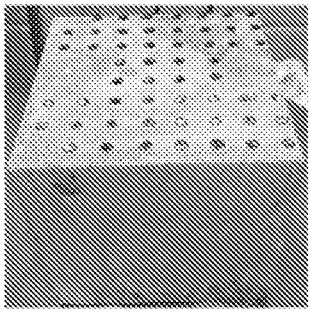
Figure 6:
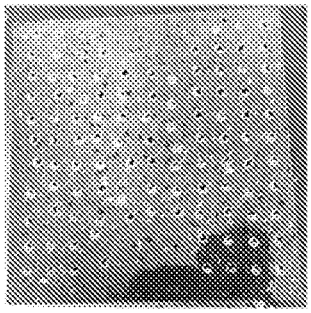
Figure 6:
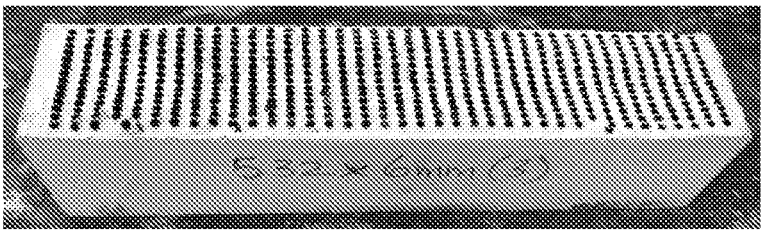
Figure 6:
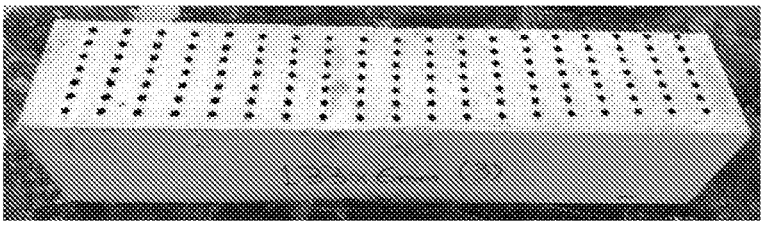

Cement-based material pads comprising a plurality of drainage holes/pores (referred to herein as clogging resistant permeable pavement (CRP)) with target porosity ranging from 2-30% were prepared by introducing conduits (plastic tubes) of varying diameter (3-6 mm) and number into self-compacting mortar (FIG. 6). Self-compacting mortar was prepared using CEM I 52.5 N (711 kg/m$^3$) and fine-grained river sand (<2.5 mm, 1323 kg/m$^3$) at a w/c ratio of 0.4. The specific gravity of sand was 2.76 and 24-h absorption was 0.7%. A polycarboxylic-ether type superplasticiser (MasterGlenium 315C) was utilized at 0.25% wt. of cement to achieve the desired workability. Mix compositions of CRP are shown in Table 2. The number and size of the conduits (plastic tubes) were varied in order to achieve different porosities. The CRP samples were cast in steel moulds (100×100×100 mm cubes or 100×100×500 mm prisms) and Perspex tubes (100Ø×150 mm), with the conduits (plastic tubes) held in place using two steel mesh sheet fixed at the top of the moulds. Overall 97 CRP samples were prepared using this method.

TABLE 2

Mix compositions of high strength clogging resistant permeable pavement (CRP).

| Mix | No of tubes × diameter of tubes (mm) | Cement (kg/m$^3$) | Sand (kg/m$^3$) | Water (kg/m$^3$) | SP (%) | w/c | Target porosity (%) |
|---|---|---|---|---|---|---|---|
| 2% P | 21 × 3 | 697 | 1297 | 278 | 0.25 | 0.4 | 2 |
| 4% P | 42 × 3 | 683 | 1270 | 273 | 0.25 | 0.4 | 4 |
| 4% P* | 11 × 6 | 683 | 1270 | 273 | 0.25 | 0.4 | 4 |
| 5% P | 21 × 5 | 675 | 1257 | 270 | 0.25 | 0.4 | 5 |
| 8% P | 84 × 3 | 654 | 1217 | 261 | 0.25 | 0.4 | 8 |
| 8% P* | 21 × 6 | 654 | 1217 | 261 | 0.25 | 0.4 | 8 |
| 11% P | 42 × 5 | 633 | 1177 | 253 | 0.25 | 0.4 | 11 |
| 15% P | 42 × 6 | 604 | 1125 | 241 | 0.25 | 0.4 | 15 |
| 21% P | 84 × 5 | 562 | 1045 | 224 | 0.25 | 0.4 | 21 |
| 30% P | 84 × 6 | 498 | 926 | 199 | 0.25 | 0.4 | 30 |

*Mixes of similar porosity are differentiated by using an asterisk.

All CRP and PC-Lab samples were covered with wet hessian and polyethylene sheet for the initial 24 hours, before being de-moulded and placed in a fog room at a temperature of 20° C., 95%±5% RH for 28 days prior to testing for compressive strength, porosity and permeability. For CRP, the protruding part of the conduits (plastic tubes) were trimmed using a hot wire in order to produce a flat surface for testing.

In addition, 24 permeable concretes available on a commercial basis (PC-Com) were acquired from a major supplier based in the United Kingdom and tested as a comparison against those samples which had been prepared in the laboratory. The PC-Com samples were 100Ø×150 mm cylinders and their porosity ranged from 15-32%. These samples were made of CEM I cement, limestone coarse aggregate of 4 to 10 mm particle size, super-plasticizer, water, stabiliser and retarder.

Porosity

In order to obtain the porosity (ϕ) of permeable concrete (PC-Lab and PC-Com), the mass of the saturated-surface dry sample in air and in water was measured.

$$\phi = \left[1 - \frac{(W_3 - W_1)}{V\rho_w}\right] \times 100\% \tag{1}$$

Where $W_1$ is the sample mass (kg) in water, $W_3$ is the saturated surface dry sample mass in air (kg), V is the sample volume (m$^3$) and $\rho_w$ is the density of water (1000 kg/m$^3$). Before $W_1$ was measured, any trapped air was removed by keeping the sample submerged in water for a minimum of 30 minutes, inverting it and tapping it on a regular basis. Per mix, six replicates were recorded and averaged.

Porosity of CRP was calculated from the size and number of straight pores (plastic tubes) in the mix:

$$\phi = \left[\frac{V_p \times n}{V_c}\right] \times 100\% \tag{2}$$

Where $V_p$ is the volume of each pore (conduit), n is number of pores and $V_c$ is the volume of the cylindrical sample (m$^3$). Results were confirmed experimentally by filling the pores with water and dividing its volume by the volume of the sample. Porosity was recorded and averaged on 7 replicates per mix.

Compressive and Flexural Strength

Compressive strength of all samples was measured in accordance with BS EN 12390-3, Testing hardened concrete, Part 3: Compressive Strength of Test Samples, British Standards Institution, London, 2009 on 100 mm cubes (for PC-Lab and CRP samples) and 100Ø×150 mm cylinders (for PC-Com samples) at 28 days, using three replicates per mix for PC-lab and PC-Com and six replicates for CRP. Samples were placed between two 150×150×25 mm metal plates so as to guarantee constant loading at a rate of 0.3 MPa/s to ultimate failure. Flexural strength ($f_r$) of CRP samples was measured using the four-point bending test setup in accordance to BS EN 12390-5:2009, Testing hardened concrete, Part 5: Flexural Strength of Test Specimens, British Standards Institution, London, 2009 on 100×100×500 mm prims at 28 days, using three replicates per mix. Flexural strength was calculated using the equation $f_r = FL/bd^2$, where $f_r$ is the flexural strength (MPa), F is the maximum load (N), L is the distance between supporting rollers (mm), and b and d are the width and depth of the sample (mm).

Permeability

A falling head permeability setup was used to measure permeability, this is described in A. Kia et al., J. Environ. Manage. 193 (2018), 221-233, the entire contents of which are incorporated herein by reference. Each sample first had to be pre-conditioned, this was achieved by directing a flow of water through the setup until there was no remaining visible trapped air to ensure complete saturation. The test was initiated by closing valve 1 to fill the graduated cylinder with water. Valve 1 was then released and the time (t) required for the water level to fall from an initial head $h_1$ (1000 mm) to a final head $h_2$ (250 mm) was recorded. The permeability cell was drained and the rig was cleaned at the end of each clogging test through the use of valve 2. For each sample, this procedure was repeated three times and the average time t was used to determine hydraulic conductivity (k, m/s) as per Darcy's law:

$$k = \frac{A_1}{A_2}\frac{L}{t}\ln\left(\frac{h_1}{h_2}\right) = k'\frac{\rho g}{\mu} \tag{3}$$

Where $A_1$ is the internal cross-sectional area of the inlet pipe (m$^2$), $A_2$ is the cross-sectional area of the sample (m$^2$) and L is the sample length (m). Hydraulic conductivity (k, m/s) can be converted to intrinsic permeability (k', $m^2$) by accounting for the fluid density (ρ, $kg/m^3$) and dynamic viscosity (μ, $Ns/m^2$), and gravitational acceleration (g, $m/s^2$). However, clogging changes fluid density and viscosity during the test, so results will be expressed as hydraulic conductivity. For each mix, hydraulic conductivity was measured on 3 replicates for PC-Lab, 6 replicates for PC-Com and 2-4 replicates for CRP, and averaged.

Clogging After Cyclic Exposure

In order to determine clogging, samples were exposed to aqueous solutions containing bentonite clay and/or fine-grained river sand (<1.25 mm), this exposure was carried out over many cycles. The $d_{50}$ value of the river sand was ~108 μm. The bentonite clay comprised of agglomerated particles of <150 μm. Table 3 details the two exposure methods used: a) combined "sand and clay (S & C)" and b) alternate "sand or clay (S/C)" loading. During each clogging cycle permeability (k) was recorded, this was repeated until complete clogging occurred. Complete clogging is here defined as when no measurable flow (k→0) or measurable change in permeability (Δk→0) was observed. Several conventional permeable concretes were subjected to trials using varying amounts of clay and sand in order to find the appropriate loading rates. It was determined that applying 0.8 $g/cm^2$ of sand or 33.3 g/L of clay per cycle led to a measurable reduction in hydraulic conductivity and complete clogging would occur within a span of ~ten cycles. This loading rate simulates a severe clogging scenario and represents a good compromise to achieve measureable change within a reasonable test duration. Further details are presented in Kia et al., J. Environ. Manage., 2018, 193, 221-233, the entire contents of which are herein incorporated by reference.

Results and Discussion

Compressive Strength

Figure 7:
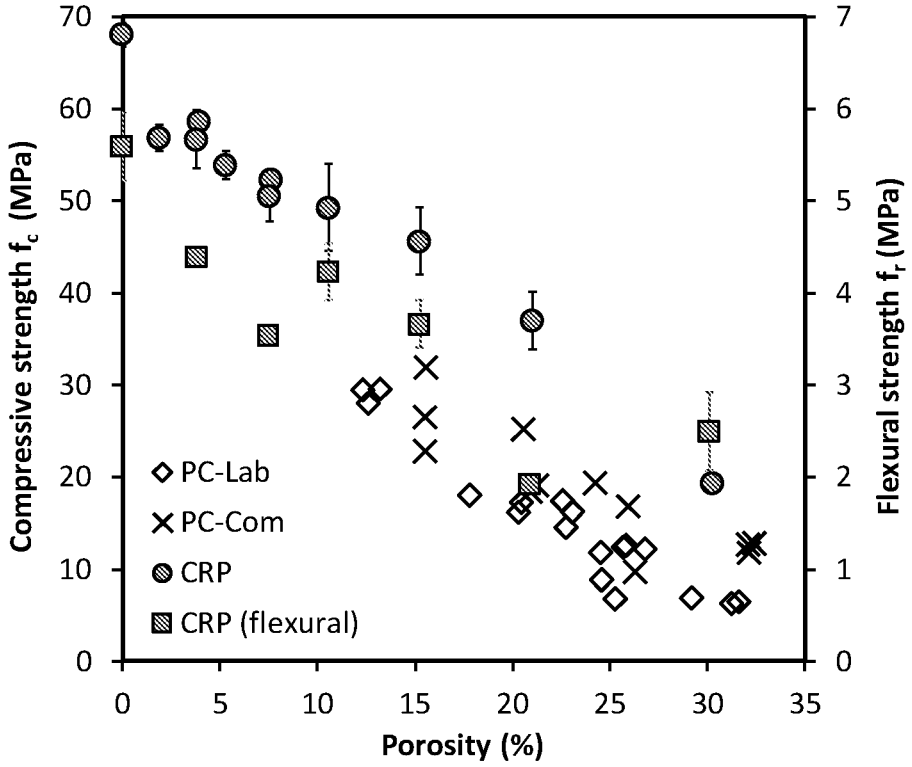
FIG. 7 shows the relationship between compressive strength, flexural strength and porosity for conventional permeable concretes (PC-Lab and PC-Com) and high-strength clogging resistant permeable pavement (CRP) at 28-days.

There are a range of factors which influence the compressive strength of permeable concrete. Porosity, cement content, w/c ratio, compaction during placement and the characteristics of the aggregate are all known to have an effect. FIG. 7 presents compressive strength plotted against porosity for all samples. For conventional permeable concretes (PC-Lab and PC-Com), compressive strength ranged from 6 to 32 MPa for porosities of 12 to 32%. In contrast, the compressive strength for CRP from 19 to 59 MPa for porosities of 2 to 30%. As expected, strength was inversely proportional to porosity with $R^2$>0.9. A 1% increase in porosity would lead to a decrease in strength of between 3-4% on average.

At comparable porosity, the compressive strength of PC-Lab was noted to be slightly lower than that of PC-Com. There are a number of reasons why this should be the case, these include variations in aggregate and binder type, the smaller pore sizes which arise from the smaller aggregates used in PC-Com, as well as the paste drain down present in most PC-Com samples which served to improve particle bonding. However, the compressive strength of CRP was substantially higher than the conventional permeable concretes. In fact, the compressive strength of CRP is about twice that of PC-Lab or PC-Com at similar porosity. This is attributed to higher cement paste content, the modified pore distribution and the lack of coarse aggregate in CRP.

According to Design Manual for Roads and Bridges, 2015. Pavement Design and Construction: Pavement Construction Methods. Report Number: HD 27/15, the entire contents of which are incorporated herein by reference, the characteristic compressive strength for pavements used in highways should reach at least 25 MPa before opening to traffic. All of the CRP apart from the 30% porosity sample have achieved 28-day compressive strength values that are much greater than 25 MPa. In contrast, conventional permeable concretes typically have strengths lower than 25 MPa, as shown in FIG. 7.

Flexural Strength

As shown in FIG. 7, the flexural strength for CRP ranged from 1.9 to 4.4 MPa for porosities ranging from 4 to 30%. Flexural strength was inversely proportional to porosity as expected, and was substantially lower than compressive strength. Decreasing the diameter and number of vertical tubes led to improved interlocking and this meant that fracture has to propagate through a thicker mortar matrix, thus increasing strength. Nevertheless, the flexural strength of CRP was only 5-13% of its compressive strength. In contrast, the flexural strength of conventional concrete is about 10-15% of its compressive strength.

A number of studies have investigated the mechanical properties of conventional permeable concrete (PC) pavements. The flexural strength of PC generally ranges from 1.0 to 3.5 MPa with porosities of 20 to 30%. Therefore, the flexural strength of CRP is slightly higher than that of conventional PC of similar porosity. This may be due to the different pore structure and lack of coarse aggregate particles in CRP.

Figure 8:
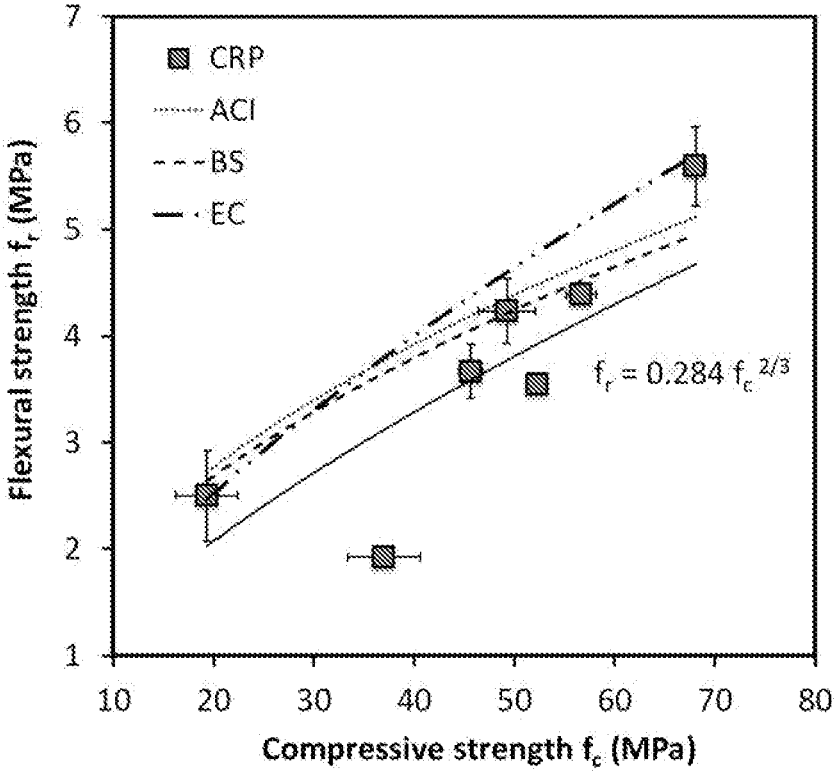
FIG. 8 shows the correlation between 28-day flexural and compressive strength for clogging resistant permeable pavement (CRP). The relationships proposed by ACI 318, BS 8110 and Eurocodes (BS EN 1992) for conventional concrete are shown as reference.

Flexural strength is an important design parameter for PC pavements, but the test is sensitive to sample preparation, curing procedure and damage during handling. As such, many highway agencies suggest the use of compressive strength testing for quality assurance of concrete pavements. It is also common to use empirical relationships derived from conventional concrete, to estimate flexural strength from compressive strength for use in pavement design. But it is unclear whether these equations are applicable to CRP. To address this, FIG. 8 presents the correlation between flexural and compressive strength for CRP. Non-linear regression found that the best-fit power model is in the form of $f_r=0.284\ f_c^{2/3}$. This is compared against the relationships proposed by ACI 318 ($f_r=0.62\ f_c^{0.5}$), BS EN 1992-1-1:2004+A1:2014, Design of concrete structures, Part 1-1: General rules and rules for buildings, British Standards Institution, London, 2014 ($f_r=0.342\ f_c^{2/3}$) and BS 8110-1:1997, Structural use of concrete. Code of practice for design and construction, British Standards Institution, London, 1997 ($f_r=0.6\ f_c^{0.5}$) for conventional concrete. It can be seen that these equations tend to over-estimate the flexural strength of CRP.

ACI Committee 325, 1991. Guide for Construction of Concrete Pavements and Concrete Bases. Report number: ACI 325.9R-91. American Concrete Institute states that the 28-day flexural strength for pavements should reach 3.9 MPa before opening to traffic. All of the CRP samples with porosity <20% satisfy this criteria. In contrast, conventional permeable concretes typically have flexural strength lower than 3.5 MPa.

Permeability of Unclogged PC

Figure 9:
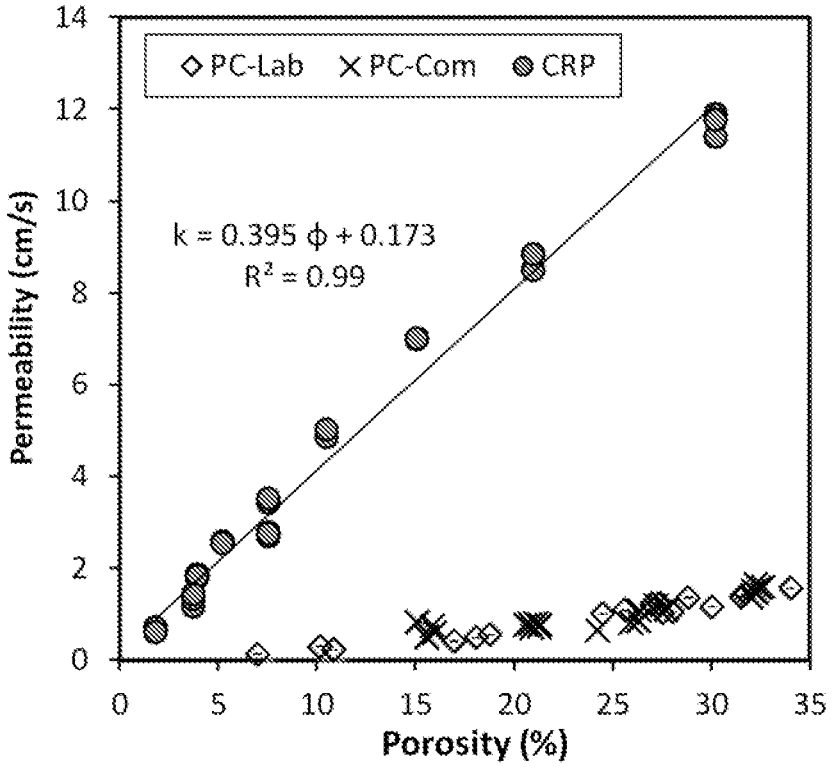
FIG. 9 shows the relationship between permeability and porosity for conventional permeable concrete (PC-Lab, PC-Com), and high-strength clogging resistant permeable pavement (CRP).

The correlation between original (unclogged) permeability and porosity of PC-Lab, PC-Com and CRP is demonstrated in FIG. 9. Permeability varied across an order of magnitude from 0.1 to 1.7 cm/s for conventional PC, and from 0.6 to 11.9 cm/s for CRP. As was expected, permeability increased with porosity. Furthermore, there is a strong linear relationship between permeability and porosity for CRP ($R^2$ of 0.99). This suggests that the initial permeability of CRP can be estimated from the measured porosity. It should be noted that the error bars are small and not visible in FIG. 9. This shows that there is no significant variation between replicate permeability values and that the mean value can therefore be taken as representative.

For similar porosities, the permeabilities of CRP were about an order of magnitude larger than that of PC samples. The permeability of the densest CRP (<5% porosity) were as high as the permeability of the most porous PC tested (>30% porosity). Therefore, CRP can be engineered with low porosity and very high strength (>50 MPa), yet with equal flow performance to conventional PC. This striking behaviour can be explained by differences in the pore structure. The pores in conventional PC have a complex structure with variable cross-sections and random interconnectivity. The pores are highly tortuous and heterogeneous. Tortuosity is related to the inverse of connectivity, and usually defined as the ratio of actual flow path length to the straight distance between the ends of the flow path (J. Bear, Dynamics of Fluids in Porous Media, Dover Publications, New York, 1988). Pores in conventional PC produce large tortuosity (>1), the exact value varies depending on flow path. Conversely, CRP has a homogenous pore structure of constant cross-section and tortuosity of 1. Therefore, flow occurs much faster through CRP compared to conventional PC, resulting in substantially higher permeability.

Estimating Permeability from Pore Structure

Considering that the pore structure of the cement-based material pad consists of simple straight cylindrical tubes of constant cross section, it is possible to calculate the permeability can be calculated from first principle thereby avoiding the need for testing. One approach is to combine Darcy's law with Hagen-Poiseuille's equation. Darcy's law (Eq. 4) relates permeability (k, m/s) to volumetric flow rate (Q, $m^3/s$), hydraulic gradient (i) defined as the ratio of hydraulic head to sample thickness $$\left(\frac{\Delta h}{L}\right),$$

and cross-sectional area or me porous medium (A, $m^2$).

$$k = \frac{Q}{Ai} = \frac{QL}{A\Delta h} \tag{4}$$

Figure 11:
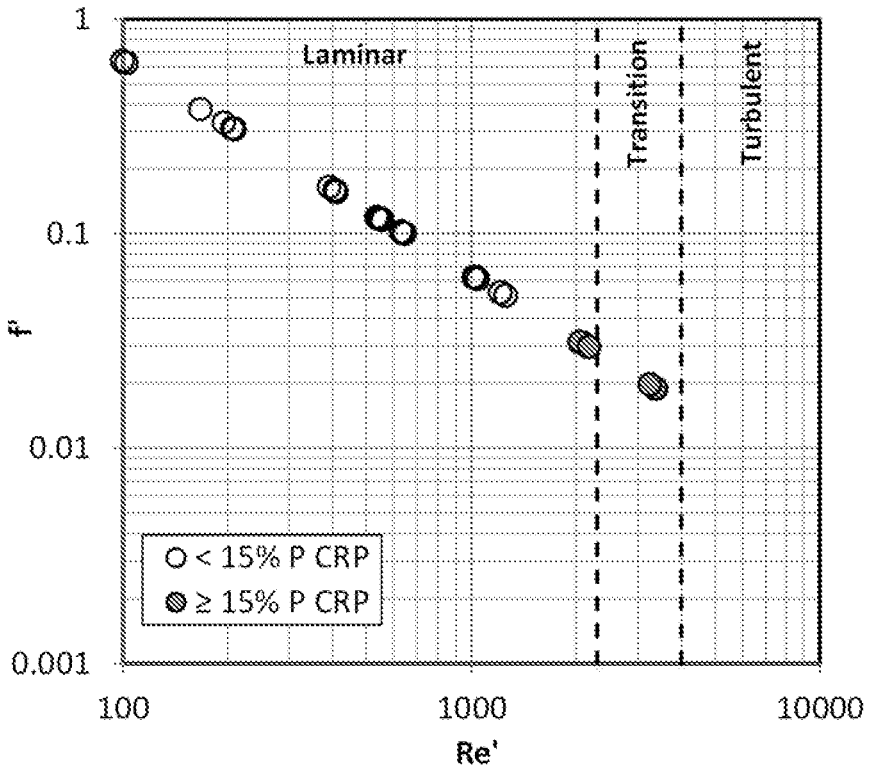
FIG. 11 demonstrates determination the flow regime for clogging resistant permeable concrete (CRP) from the Darcy friction factor $f_D$ and Reynold's number Re calculated from experimental data (falling head permeability).

Hagen-Poiseuille's equation (Eq. 5) describes the laminar flow of incompressible Newtonian fluid through a tube of constant circular cross section, with length substantially longer than the diameter, and with no acceleration of fluid in the tube:

$$Q = \frac{\pi R^4 \varrho g \Delta h}{8\mu L} \tag{5}$$

where Q is volumetric flow rate ($m^3/s$), R is radius of the cylindrical pipe (m), ρ is the fluid density (1000 $kg/m^3$), g is the gravitational acceleration ($m/s^2$), Δh is the change in hydraulic head (m), μ is dynamic viscosity of fluid, (0.001 Pa s for water) and L is the length of the tube. Combining Eq. 4 and Eq. 5 for n number of conduits in a sample gives:

$$k = \frac{n\pi R^4 \varrho g}{8\mu A} = \frac{\phi R^2 \varrho g}{8\mu} \tag{6}$$

where ϕ is the sample porosity ($=n\pi R^2/A$). The results presented in FIG. 11 show that Eq. 6 over-estimates the measured permeability by a substantial margin ranging from 8× to 30× difference. The error increases with porosity. One possible explanation is that the Hagen-Poiseuille equation tends to fail for low viscosity fluids in wide and/or short tubes. For short tubes, the Hagen-Poiseuille equation gives unrealistically high flow rates and therefore overestimates permeability. In such a case, the flow rate should be bounded by Bernoulli's principle instead:

$$Q = \pi R^2 \sqrt{2g\Delta h} \tag{7}$$

Combining Eq. 4 and Eq. 7 gives:

$$k = \frac{n\pi R^2 L \sqrt{\frac{2g}{\Delta h}}}{A} = \phi L \sqrt{\frac{2g}{\Delta h}} \tag{8}$$

Figure 10:
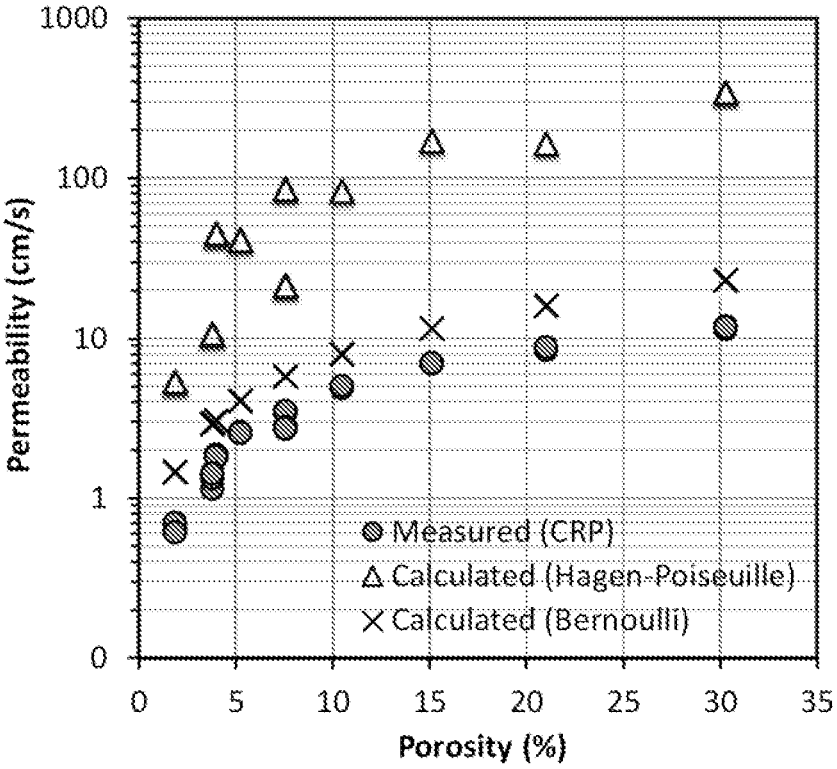
FIG. 10 shows a comparison between falling head permeability for clogging resistant permeable pavement (CRP) and calculated permeability using Hagen-Poiseuille and Bernoulli's equations.

FIG. 10 shows that Eq. 8 also over-estimates measured permeability, but with a much improved agreement compared to Eq. 6. The error is about a factor of 2 at most. At large porosities (≥15%), the error increased slightly, which could be attributed to the flow regime being close to or within the transitional region (discussed in Section 3.5). Nevertheless, Eq. 8 will serve as a basic guide for designers to estimate the permeability of cement-based material pads from known porosity (ϕ). It should be noted that the permeability of conventional permeable concrete (PC-Lab and PC-Com) can be estimated from pore structure using a Kozeny-Carman type equation.

Flow Regime

Darcy's law, Hagen-Poiseuille and Bernoulli's equations for determining permeability assumes laminar flow and all are invalid in the event that the flow becomes turbulent. However, high flow rates occur when testing hydraulic conductivity of CRP and this might induce turbulent flow. In order to check this assumption, the Darcy-Weisbach equation was applied to determine the flow regime inside cement-based material pads as follows:

$$f_D = \frac{64}{Re} \tag{10}$$

where $f_D$ is the friction factor and Re is the Reynolds number defined as:

$$Re = \frac{\varrho\, vD}{\mu} \tag{11}$$

where ρ is the fluid density (1000 $kg/m^3$), v is the mean flow velocity (m/s) obtained by multiplying the measured permeability (k, m/s) by hydraulic gradient (i), D is the diameter of the cylindrical tube (m) and μ is fluid dynamic viscosity (0.001 Pa s for water).

The flow through a circular pipe is typically laminar when Re≤2300, turbulent when Re≥4000 and transitional in between. The results presented in FIG. 11 show that the flow regime in all CRP, except the 30% P samples, were within the laminar region. The 15% P and 21% P samples were close to the transitional regime, and this could have contributed to the high calculated permeability (FIG. 9). The flow regime through PC-Lab and PC-Com samples was discussed extensively in Kia et al., J. Environ. Manage., 2018, 193, 221-233.

Effect of Clogging on Permeability

Figure 12:
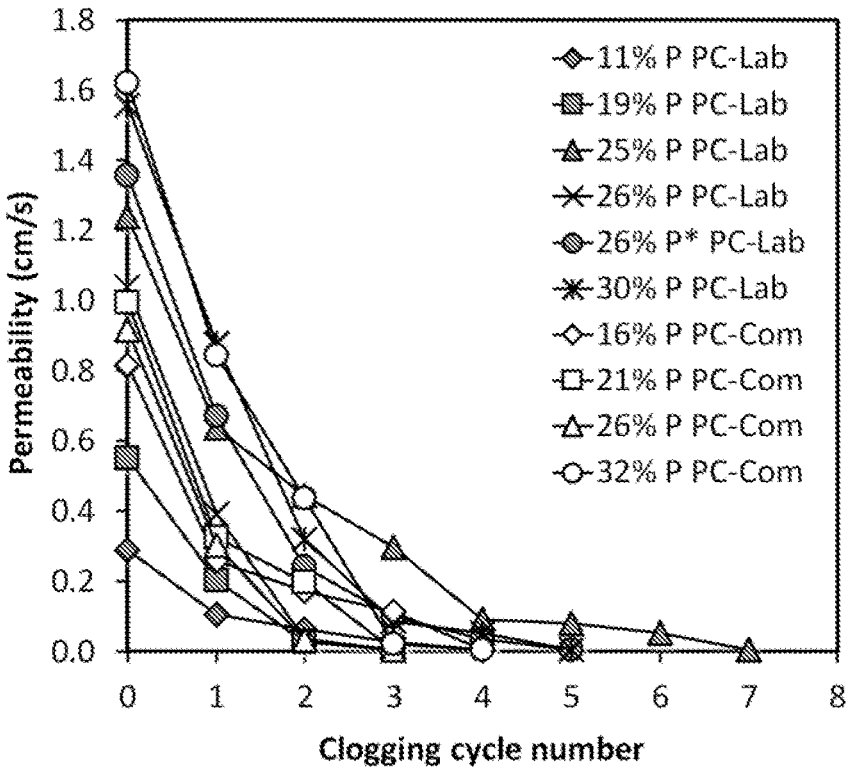
FIG. 12 shows the permeability of a) conventional permeable concrete (PC) and b) clogging resistant permeable pavement (CRP) exposed to combined "sand & clay" loading.
Figure 12:
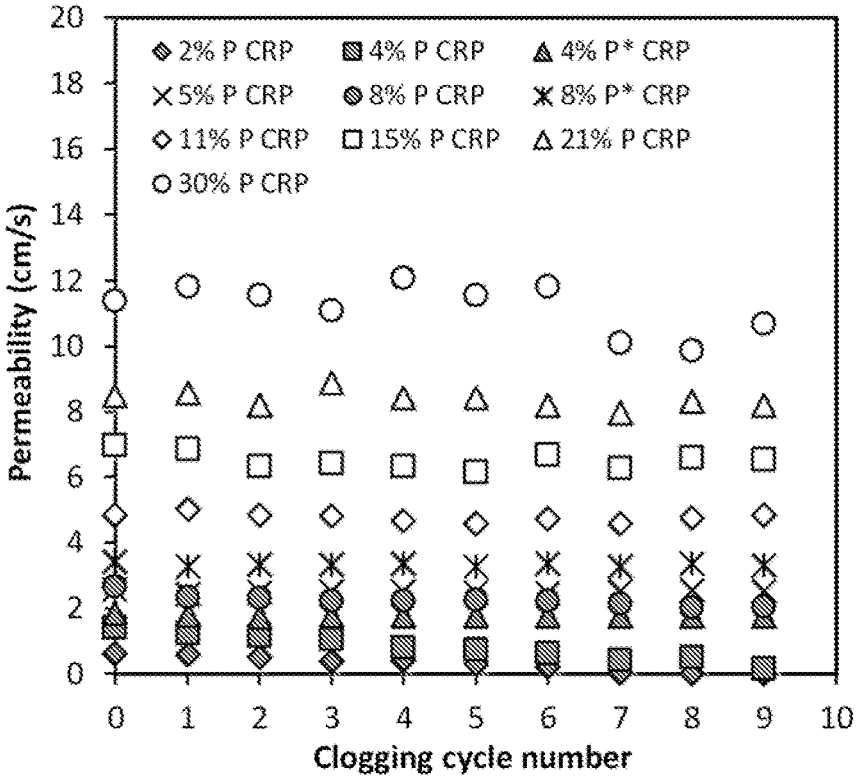
Figure 13:
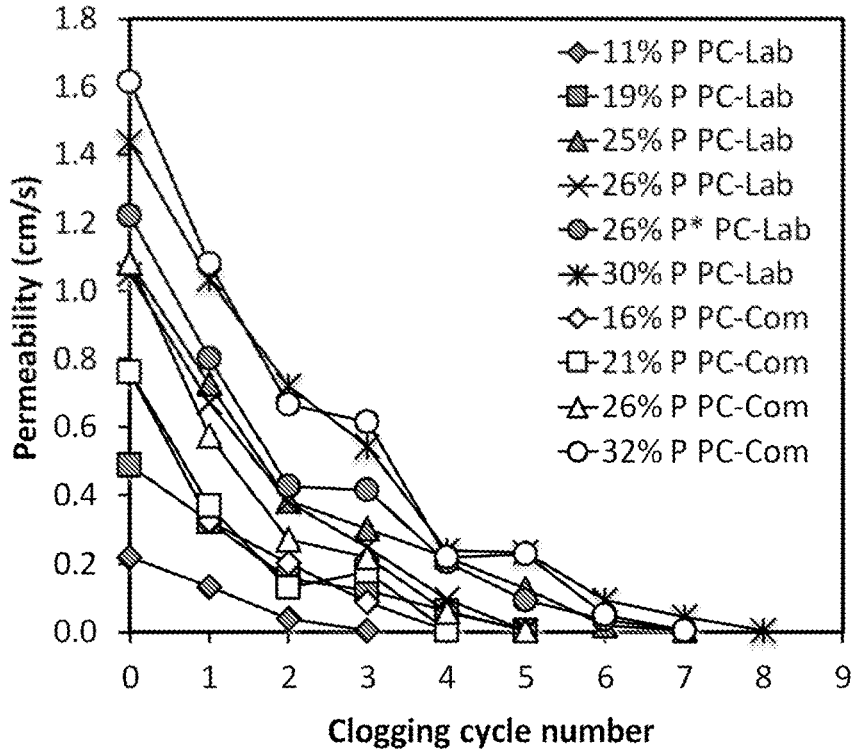
FIG. 13 shows the permeability of a) conventional permeable concrete (PC) and b) clogging resistant permeable pavement (CRP) exposed to alternate "sand/clay" loading.
Figure 13:
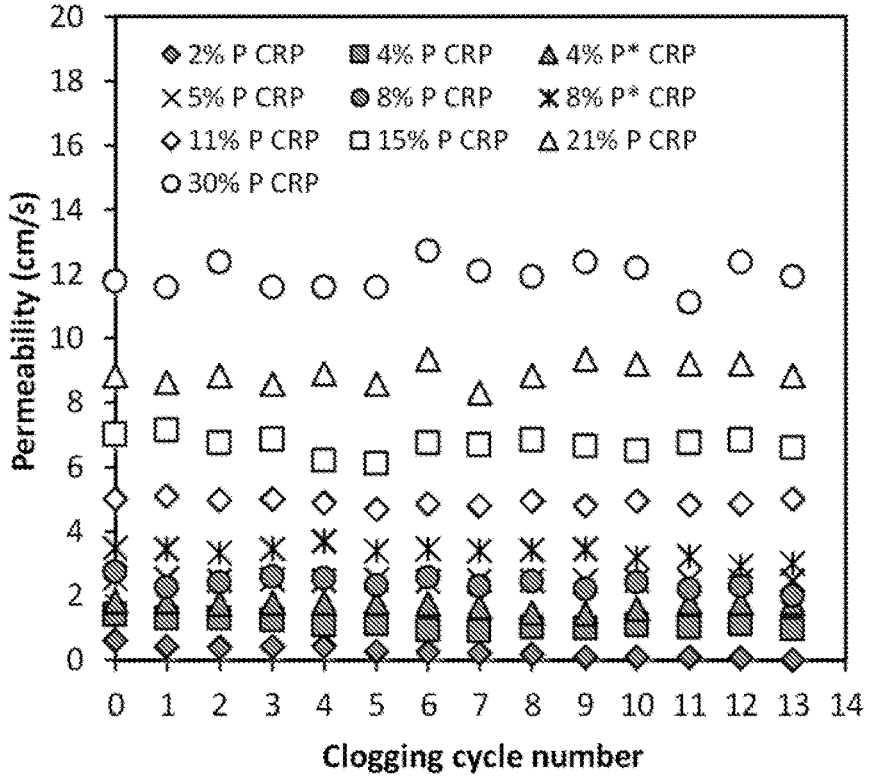

FIG. 12*a* and FIG. 13*a* shows the effect of clogging on permeability for all conventional permeable concretes (PC-Lab and PC-Com) subjected to the combined S & C loading or alternate S/C loading. For all samples, the highest permeability occurred initially, but permeability decreases at an exponential rate with increasing number of clogging cycle. This is caused by blockage of pores by sediments that consequently decreases porosity and increases tortuosity. This occurred even for the most porous PC samples (32% P). Complete clogging occurred after a number of cycles, the exact number was dependent on the porosity of a particular sample and the clogging method used. A more rapid loss of permeability was observed in the combined S & C clogging method as there was a simultaneous application of both sand and clay in each cycle. In the combined S & C loading, complete clogging occurred after 3-7 cycles, as opposed to 3-8 cycles for alternate S/C loading.

Low porosity (11% and 19%) PC samples clogged rapidly as a result of smaller pore volume and size as well as higher tortuosity. This encourages trapping of solid particles within the pore structure leading to accumulation. Samples that were affected by paste drain down also clogged rapidly due to blockage of the pore structure leading to poor infiltration capacity. In cases where VMA was added to the same mix in order to mitigate paste drain down, the resulting samples both demonstrated higher initial permeability and were able to withstand a higher number of loading cycles before becoming fully clogged. The clogging behaviour of PC-Lab and PC-Com samples of equivalent porosity was similar and they withstood about the same number of cycles before becoming fully clogged.

FIG. 12*b* and FIG. 13*b* shows that the effect of cyclic clogging on CRP is very different compared to conventional PC. The majority of CRP showed no reduction in permeability despite extensive exposure to sediments over many clogging cycles. The samples showed similar behaviour when subjected to combined S & C loading or alternate S/C loading. This highlights the effectiveness of CRP in resisting clogging, which is attributed to the engineered pore structure that consists of vertical channels with tortuosity of 1 and no constrictions. This enabled particulates to flow through without being trapped within the pore structure. It is also interesting to note that some CRP with porosity as low as 4% did not clog, despite the fact that they had similar initial permeability to conventional PC at 32% porosity. This suggests that low tortuosity and lack of constrictions (constant pore cross-section) are the governing factors that influence clogging.

As expected, the permeability of CRP with extremely low porosity (2%) decreased with cyclic loading. Combined S & C loading produced full clogging after 8 cycles. In contrast, the alternate S/C loading caused complete clogging after 13 cycles. Similarly, the 4% P CRP sample clogged after 9 cycles of the combined S & C loading only. This was attributed to the small diameter of the pores (3 mm) combined with the presence of only a small number of pore channels in these samples. When the number of pores increased at constant 3 mm diameter, such as the 8% P sample (84×3 mm tubes), full clogging was not observed. In addition, clogging was avoided in low porosity samples by incorporating larger tubes. For example, the 4% P*CRP prepared using 11×6 mm tubes (Table 2) did not clog in either combined S & C or alternate S/C loading. It is also worth noting that samples with similar porosity but larger pore size gave higher permeability. For example, the permeability of 8% P*(21×6 mm) was 50-60% higher than that of 8% P (84×3 mm) at the end of the cyclic clogging experiments.

Visual Assessment of Clogging

Visual inspection during combined S & C loading for conventional PC and low porosity 4%) CRP found that initially sand particles retain on the top surface (PC and CRP) or within the first quarter of the sample (PC), while the majority of the clay passing through. The amount of retention increases with each subsequent cycle up to the point at which full clogging is achieved. The clay is well mixed into the slurry before this is applied, but even so, flocculated clay tends to attach onto the surface of sand particles, which will then bond and form a thick layer on the sample. This layer increases in thickness the greater the number of clogging cycles the sample has been subjected to. For CRP with porosity ≥8%, most of the sand and clay passed through with very little sand accumulating on the top surface. The degree of retention is dependent on sample porosity as well as sediment size relative to pore size, so that samples with large pores or greater number of tubes have far less sand accumulation.

For S/C loading, the nature of the top layer was related to the cycle in which full clogging took place. A layer of sand was seen to form on the top surface of the sample in cases where clogging occurred during an odd cycle number. However, a layer of both clay and sand was observed on the top surface of the sample in those cases where clogging occurred during an even cycle number. CRP with large pores (5 and 6 mm) did not show any pore blockage, and accumulation of sediments was only observed on the surface of a small number of CRPs with 3 mm pores. Dismantling the samples after the tests showed that there was very little clay particles present in the sample. This suggests that in cases where clay is well-dispersed in water, it will simply pass through the sample, doing very little to bring about clogging unless it becomes flocculated and accumulates either inside the sample or on its top surface. Therefore, the actual deposition pattern is largely dependent on the exposure and particle size relative to the pore size.

Delivering CRP on Site

In order for this novel concept to be a truly successful innovation, it is also necessary to examine the means by which cement-based material pads can be scalable and delivered on site. The use of highly flowable self-compacting mortar will facilitate this, but formation of the vertical pore channels of low tortuosity remains a challenge. Here, we briefly discuss, in non-limiting fashion, several possible methods.

One approach relies on the use of a grid of solid channels that is filled with self-compacting mortar. Subsequently, the grid is dissolved leaving vertical pore channels in the hardened mortar. The challenge is to engineer the grid such that it has sufficient initial strength and rigidity, yet can be easily and fully dissolved. There is also a need to ensure that the process does not cause groundwater contamination or clogging of the aggregate sub-base layer.

Figure 14:
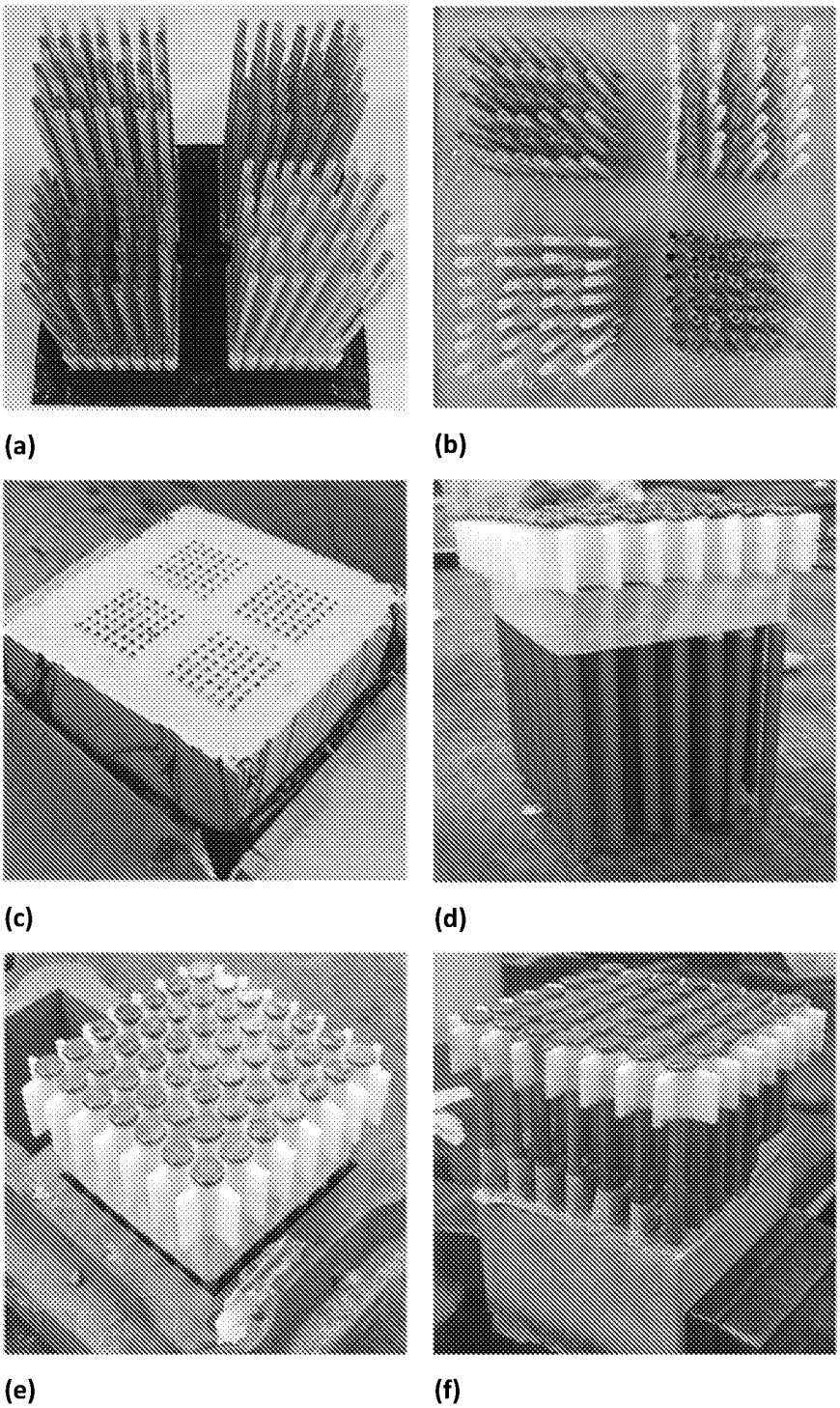
FIG. 14 shows possible site delivery methods for clogging resistant permeable pavement (CRP): a-c) grid supporting vertical hollow tubes cast in self-compacting mortar; d-f) grid of protruding rigid pins fitted with plastic tubes and cast in self-compacting mortar. The pins are subsequently lifted and reused.

Another approach, which is a variation of the method described above, involves placing a grid of vertical conduits (FIG. 14*a*) directly on the aggregate sub-base layer. Self-compacting mortar is then poured over the grid to the required pavement thickness and the grid is buried permanently in the hardened mortar (FIG. 14*b, c*). The advantage of this method is its simplicity and scalability. The flexible membrane sheet supporting the tubes prevents clogging of the sub-base layer with self-compacting mortar. Once the mortar has set, any protruding conduits can be cut down flush to the mortar surface using a hot wire device. This process will be very quick, and easy to perform whilst resulting in a smooth surface finish (FIG. 14*c*).

The third approach consists of a grid of protruding rigid pins, where each pin is fitted with a conduit that is cast into self-compacting mortar (FIG. 14*d-f*). The pins should be pushed into the aggregate sub-base to avoid blockage of the conduits with self-compacting mortar. The grid is then lifted and reused, leaving behind the embedded conduits to form vertical channels. This method can be scaled up to lift large grids. It is also proposed that these grids would interlock and stack vertically enabling a large number to be transported and positioned on site.

In-Situ Delivery Method

High-strength clogging resistant permeable pavement can be supplied as both in-situ continuous pour and pre-cast elements.

Figure 15:
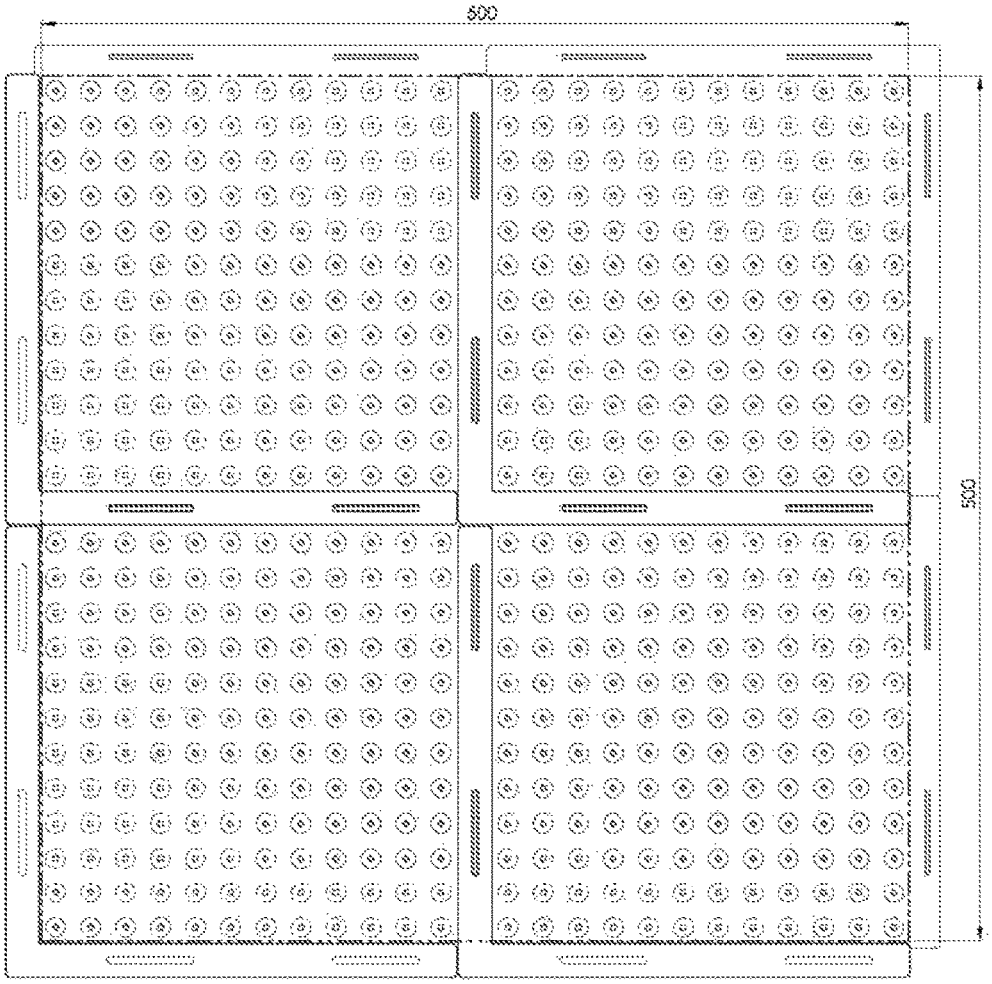
FIG. 15 shows injection moulded interlocking tiles and conduit assembly for site production of high-strength clogging resistant permeable pavement.
Figure 15:
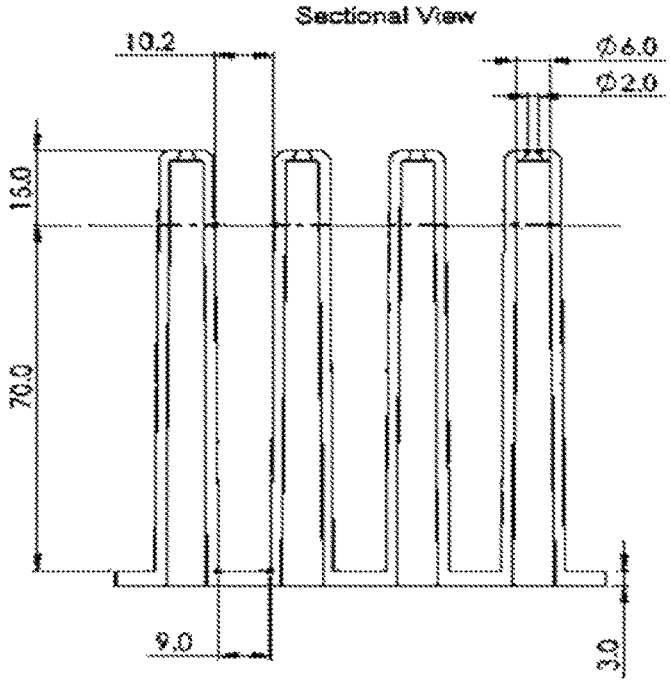

An in-situ continuous pour method may involve manufacturing forms formed of plastic interlocking tiles containing a grid of vertical conduits which are placed either on an aggregate or a geocellular sub-base layer on site. Self-compacting mortar may then be applied on top of these tiles, leaving part of the vertical conduits protruding, to the required pavement thickness (e.g. 70 mm as shown in FIG. 15).

The advantage of this method may be simplicity and scalability. Once the mortar has set, any protruding conduits (top 15 mm shown in FIG. 15) can be cut down flush to the pavement surface using, for example, a hot wire device. This process can be quick, and easy to perform whilst resulting in a smooth surface finish.

The tiles may be interlocking for ease of transportation and installation. The interlocking tiles and conduits may be manufactured as one piece using an injection moulding technique Current generation permeable pavements require extensive knowledge and expertise if they are to be properly deployed on site. If they are deployed using insufficient compaction, this will lead to low strength and surface raveling, whilst over-compaction reduces void content and the ability of the pavement to drain surface water. As such, specialist contractors are required for delivering conventional systems on site.

Conversely, a significant advantage of the method disclosed herein is that no such expertise is required. The forms formed of tiles containing the grid of vertical conduits are simply placed over an aggregate sub-base. The self-compacting mortar is then applied over the tiles and once set; the protruding conduit portions are cut down flush to the pavement surface. This will result in a continuous pavement that is wet poured on site (in-situ delivery method).

Pre-Cast Delivery Method

A pre-cast method may involve the use of dry pressed cement-based material to form tiles of the pad. The dry pressed tiles may be pre-cast in factories as pavers and flags. The tiles can also be pre-cast in factories using polymer concrete or any other material.

CONCLUSIONS

A new type of cement-based material pad that is resistant to clogging, yet achieves high permeability and compressive strength that can be poured on site has been developed. This high-strength clogging resistant permeable pavement (CRP) was tested against a wide variety of conventional laboratory prepared and commercially available permeable concrete (PC) samples. Some of the test variables were aggregate particle size (1.25 to 14 mm), pore diameter (3 to 6 mm), effective porosity (2 to 32%) and clogging method (combined sand and clay, or alternate sand/clay). The main findings of this disclosure are:

a) CRP can be cast on-site to achieve uniform pore structure at low tortuosity (=1). It retains high porosity and permeability for storm-water to infiltrate throughout, while having high compressive strength suitable for use in heavily loaded pavements.

b) Compressive strength of CRP varied from a low of 19 to a high of 59 MPa compared to 6 to 32 MPa for conventional PC. At equivalent porosity, the compressive strength of CRP is about twice that of conventional PC. This is due to the higher cement paste content, the specific porosity distribution and the lack of coarse aggregate in CRP. Flexural strength of CRP ranged from 1.9 to 4.4 MPa.

c) Initial permeability of CRP ranged from 0.6 to 11.9 cm/s compared to 0.1 to 1.7 cm/s for conventional PC. At equivalent porosity, the permeability of CRP is about an order of magnitude greater than conventional PC. This is attributed to the homogenous and low tortuosity pore structure of CRP.

d) All conventional PC experienced reduction in permeability and complete clogging after 3 to 8 cycles of exposure to sediments, this was dependent on the porosity of individual samples and the exposure method used. The combined sand and clay method resulted in a more rapid degradation of permeability. However, CRP with porosity of 5% and above showed no reduction in permeability despite exposure to sediments over many cycles. This is attributed to the pore structure that consists of vertical channels with tortuosity of 1, with no constrictions.

e) CRP can be engineered with low porosity (5%) to achieve high compressive strength (>50 MPa) and high permeability (>2 cm/s), but does not clog despite extensive cyclic exposure to flow containing sand and clay.

f) Permeability of CRP has a strong linear relationship with porosity ($R^2$ of 0.99). Furthermore, a simple method that combines Darcy's law and Bernoulli's equation is able to estimate the permeability of CRP to within a factor of two. This suggests that the permeability of CRP can be modelled from the pore structure.

g) Several potential methods for large-scale on-site delivery of CRP were presented and discussed.

While preferred embodiments of the present invention have been shown and described herein, it will be apparent to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention and that methods and structures within the scope of these claims and their equivalents be covered thereby.

The invention claimed is:

1. A method of forming a cement-based material pad comprising a plurality of drainage holes, the method comprising:

providing a form comprising a sheet and a plurality of straight conduits, each conduit having an upper end and a lower end, wherein each conduit has a constant cross-section and forms a channel from the upper end to the lower end that passes through the sheet; and the form being an open-top form whereby a cement-based material can be poured onto the sheet to surround the conduits;

placing said form; and pouring a cement-based material into said form until the cement-based material surrounds the conduits, leaving the upper ends of the conduits exposed;

wherein the plurality of conduits are arranged such that a cement-based material pad having porosity of 1 to 50% is formed; and wherein the form further comprises a connecting means holding each of the plurality of conduits parallel to one another and wherein when the cement-based material is poured onto the sheet to surround the conduits, the upper ends of the conduits and the connecting means are left exposed;

wherein the method further comprises the step of trimming a portion of each of the plurality of conduits exposed from the cement-based material; and wherein the method further comprises removing the connecting means once the cement-based material has set.

2. The method of claim 1, wherein each of the plurality of conduits are arranged substantially perpendicular to the sheet and/or wherein each of the plurality of conduits are arranged parallel to one another.

3. The method of claim 1, wherein the sheet is a flexible sheet.

4. The method of claim 1, wherein the sheet and the lower end of the conduits are adjacent.

5. The method of claim 1, wherein each of the plurality of conduits and/or the sheet is formed from plastic or a biodegradable material.

6. The method of claim 1, wherein the form further comprises side walls to contain the cement-based material.

7. The method of claim 1 further comprising the step of setting the cement-based material.

8. The method of claim 1 wherein the method is carried out on site.

9. The method of claim 1 wherein the cement-based material pad formed from the method has a compressive strength of about 50 MPa or greater.

10. A cement-based material pad comprising a plurality of drainage holes formed by a method as described in claim 1.

11. A method of forming a cement-based material pad comprising a plurality of drainage holes, the method comprising:

providing a form comprising a plurality of parallel pins each having a shaft, a head and a pointed end; a connecting means configured to hold the plurality of pins parallel to each other, wherein the connecting means connects the head of each of the plurality of parallel pins; a plurality of straight conduits, each having an upper end and a lower end; wherein each conduit has a constant cross-section and receives one of the plurality of parallel pins such that the pointed ends of each of the plurality of parallel pins extend beyond the lower end of each conduit; whereby a cement-based material can be poured to surround the conduits;

placing said form; and pouring a cement-based material into said form until the cement-based material surrounds the conduits, leaving the upper ends of the conduits exposed.

12. The method of claim 11, wherein the cement-based material pad is to be formed on a surface and the step of placing said form comprises placing said form such that the pointed ends of each of the parallel pins penetrate the surface to anchor the form.

13. The method of claim 11, wherein each of the pointed ends of each of the parallel pins extends beyond the lower end of each conduit so as to seal the lower end of the conduit.

14. The method of claim 11, wherein the connecting means extends substantially perpendicular from each of the plurality of parallel pins.

15. The method of claim 11, wherein each conduit reversibly receives one of the plurality of parallel pins.

16. The method of claim 15, wherein each of the plurality of conduits independently has a diameter of about 1 to about 20 mm.

17. The method of claim 11 further comprising the step of removing the plurality of parallel pins from each of said conduits.

18. A form for use in producing a cement-based material pad comprising a plurality of drainage holes, the form comprising:

a sheet; and a plurality of straight conduits, each having an upper end and a lower end;

wherein each conduit has a constant cross-section and forms a channel from the upper end to the lower end that passes through the sheet; and the form being an open-top form whereby a cement-based material can be poured onto the sheet to surround the conduits, leaving the upper ends of the conduits exposed;

wherein the plurality of conduits are arranged such that the form is for use in producing cement-based material pad having porosity of 1 to 50%; and wherein the form further comprises a connecting means holding each of the plurality of conduits parallel to one another and wherein when the cement-based material is poured onto the sheet to surround the conduits, the upper ends of the conduits and the connecting means are left exposed; and the connecting means is configured to be removable once the cement-based material has set.

19. A form for use in producing a cement-based material pad comprising a plurality of drainage holes, the form comprising:

a plurality of parallel pins each having a shaft, a head and a pointed end;

a connecting means configured to hold the plurality of pins parallel to each other, wherein the connecting means connects the head of each of the plurality of parallel pins;

a plurality of straight conduits, each having an upper end and a lower end;

wherein each conduit has a constant cross-section and is configured to receive one of the plurality of parallel pins;

wherein a cement-based material can be poured to surround the conduits, leaving the upper ends of the conduits exposed; and each of the parallel pins being configured such that the pointed end extends beyond the lower end of each conduit so as to prevent a cement-based material obstructing the lower end of each conduit when the cement-based material is poured to surround the conduits.

* * * * *